US011686047B2

(12) United States Patent
Geary et al.

(10) Patent No.: US 11,686,047 B2
(45) **Date of Patent: *Jun. 27, 2023**

(54) FIBROUS STRUCTURES COMPRISING TRICHOME COMPOSITIONS AND METHODS FOR OBTAINING SAME

(71) Applicant: The Procter & Gamble Company, Cincinnati, OH (US)

(72) Inventors: Nicholas William Geary, Mariemont, OH (US); Raul Victorino Nunes, Loveland, OH (US); Khosrow Parviz Mohammadi, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/510,434

(22) Filed: Oct. 26, 2021

(65) Prior Publication Data

US 2022/0042245 A1 Feb. 10, 2022

Related U.S. Application Data

(63) Continuation of application No. 16/452,582, filed on Jun. 26, 2019, now Pat. No. 11,180,888.

(60) Provisional application No. 62/691,854, filed on Jun. 29, 2018.

(51) Int. Cl.
*D21H 11/12* (2006.01)
*D21H 27/00* (2006.01)

(52) U.S. Cl.
CPC ..... *D21H 11/12* (2013.01); *D21H 27/002* (2013.01)

(58) Field of Classification Search
CPC ..... D21H 21/52; D21H 27/002; D21H 11/12
USPC ..... 162/148
See application file for complete search history.

(56) References Cited

U.S. PATENT DOCUMENTS

| | | | |
|---|---|---|---|
| 3,863,428 | A | 2/1975 | Baxter |
| 3,994,771 | A | 11/1976 | Morgan, Jr. et al. |
| 5,772,847 | A | 6/1998 | Simpson et al. |
| 6,576,083 | B2 | 6/2003 | Franks et al. |
| 6,893,473 | B2 | 5/2005 | Neogi et al. |
| 7,691,472 | B2 | 4/2010 | Vinson et al. |
| 7,811,613 | B2 | 10/2010 | Vinson et al. |
| 8,029,645 | B2 | 10/2011 | Mohammadi |
| 8,056,841 | B2 | 11/2011 | Vinson et al. |
| 8,297,543 | B2 | 10/2012 | Vinson et al. |
| 8,425,722 | B2 | 4/2013 | Mohammadi |
| 8,623,176 | B2 | 1/2014 | Vinson et al. |
| 8,808,501 | B2 | 8/2014 | Vinson et al. |
| 9,011,641 | B2 | 4/2015 | Mohammadi et al. |
| 9,718,065 | B1 | 8/2017 | Cilia |
| 10,227,729 | B2 | 3/2019 | Mohammadi et al. |
| 10,309,057 | B2 | 6/2019 | Mohammadi et al. |
| 10,344,428 | B2 | 7/2019 | Mohammadi et al. |
| 2003/0208859 | A1 | 11/2003 | Neogi et al. |
| 2004/0221975 | A1 | 11/2004 | Hernandez-munoa et al. |
| 2004/0250969 | A1 | 12/2004 | Luu et al. |
| 2005/0274470 | A1 | 12/2005 | Shannon et al. |
| 2006/0069069 | A1 | 3/2006 | Kajander et al. |
| 2006/0154832 | A1 | 7/2006 | Peltier |
| 2006/0260002 | A1 | 11/2006 | Ronen et al. |
| 2006/0288639 | A1 | 12/2006 | Vinson et al. |
| 2007/0011762 | A1 | 1/2007 | Vinson et al. |
| 2009/0054858 | A1 | 2/2009 | Cheng et al. |
| 2009/0084513 | A1 | 4/2009 | Barnholtz et al. |
| 2010/0239843 | A1 | 9/2010 | Luu et al. |
| 2011/0104419 | A1 | 5/2011 | Barnholtz et al. |
| 2011/0168342 | A1 | 7/2011 | Mohammadi |
| 2011/0226430 | A1 | 9/2011 | Mohammadi |
| 2013/0215995 | A1 | 8/2013 | Genik |
| 2013/0220563 | A1 | 8/2013 | Mohammadi |
| 2014/0083637 | A1 | 3/2014 | Vinson et al. |
| 2014/0138040 | A1 | 5/2014 | Sartini et al. |
| 2014/0141203 | A1 | 5/2014 | Sartini et al. |
| 2015/0094252 | A1 | 4/2015 | Cuyubamba et al. |
| 2015/0176216 | A1 | 6/2015 | Ostendorf et al. |
| 2015/0211186 | A1 | 7/2015 | Mcneil et al. |
| 2015/0337496 | A1 | 11/2015 | Lee |
| 2016/0160439 | A1 | 6/2016 | Mohammadi et al. |
| 2017/0175332 | A1 | 6/2017 | Mohammad et al. |
| 2017/0175338 | A1 | 6/2017 | Mohammadi |
| 2017/0335512 | A1 | 11/2017 | Mohammadi et al. |
| 2018/0007852 | A1 | 1/2018 | Rose |
| 2020/0002886 | A1 | 1/2020 | Green et al. |
| 2020/0002887 | A1 | 1/2020 | Green et al. |
| 2020/0002889 | A1 | 1/2020 | Nunes et al. |
| 2020/0002892 | A1 | 1/2020 | Geary et al. |
| 2020/0359852 | A1 | 11/2020 | Mohammadi et al. |
| 2021/0348335 | A1 | 11/2021 | Mohammadi et al. |

FOREIGN PATENT DOCUMENTS

JP H04329913 A 11/1992

OTHER PUBLICATIONS

All Office Actions; U.S. Appl. No. 17/868,234, filed Jul. 19, 2022.
Anthon et al. Pectin Methylesterase Activity and Other Factors Affecting PH and Titratable Acidity Inprocessing Tomatoes; Food Chemistry, vol. 132, pp. 915-920. (Year: 2012).
Atanasova etal. Evolution and Functional Characterization of Pectate Lyase Pel 12, A Member of Ahighly Expanded Clonostachys Rosea Polysaccharide Lyase 1 Family; BMC Microbiology, vol. 18, No. 178, pp. 1-19. (Year: 2018).
Das, B. Green Way To Recycle Paper; downloaded from: http://www.downtoearth.org.in/news/green-way-to-recycle-paper-39185, pp. 1-3. (Year: 2012).

(Continued)

*Primary Examiner* — Mark Halpern
(74) *Attorney, Agent, or Firm* — Richard L. Alexander; C. Brant Cook

(57) ABSTRACT

Fibrous structures containing trichomes, for example novel trichome compositions, methods for obtaining such novel trichome compositions, and method for making such fibrous structures are provided.

12 Claims, 19 Drawing Sheets

(56) References Cited

OTHER PUBLICATIONS

Dinu et al. Enzymes With New Biochemical Properties in the Pectinolytic Complex Produced Byastergillus Niger MIUG16; Journal of Biotechnology, vol. 131, No. 2, pp. 128-137. (Year: 2007).
U.S. Unpublished Patent Application U.S. Appl. No. 17/868,234, filed on Sep. 19, 2022, to Phillip Richard Green et. al.
All Office Actions; U.S. Appl. No. 14/963,278, filed Dec. 9, 2015.
All Office Actions; U.S. Appl. No. 15/378,430, filed Dec. 14, 2016.
All Office Actions; U.S. Appl. No. 15/602,187, filed May 23, 2017.
All Office Actions; U.S. Appl. No. 16/388,986, filed Apr. 19, 2019.
All Office Actions; U.S. Appl. No. 16/452,574, filed Jun. 26, 2019.
All Office Actions; U.S. Appl. No. 16/452,579, filed Jun. 26, 2019.
All Office Actions; U.S. Appl. No. 16/452,582, filed Jun. 26, 2019.
All Office Actions; U.S. Appl. No. 17/382,725, filed Jul. 22, 2021.
All Office Actions; U.S. Appl. No. 15/378,627, filed Dec. 14, 2016.
All Office Actions; U.S. Appl. No. 16/452,569, filed Jun. 26, 2019.
Daher et al., "How to let go: pectin and plant cell adhesion", Frontiers in Plant Science, vol. 6, Article 523, pp. 1-8, Jul. 14, 2015.
Documentation for ImageJ software, National Institute of Health, 3 pages, 2007, online], retrieved from the Internet, [retrieved Jan. 8, 2017], URL:https://imagej.nih.gov/ij/index.html.
James Mauseth, Botany, Oct. 25, 2019, Jones and Bartlett Learning, p. 76 (Year: 2019).
Martins et al., "Purification and Properties of Polygalacturonase Produced by Thermophilic Fungus *Thermoascus aurantiacus* CBMAI-756 on Solid-State Fermentation", Enzyme Research, vol. 13, Article 438645, pp. 1-7, 2013.
Zhang, et al., "A Simple and Efficient Method for Isolating Trichomes for Downstream Analyses", Plant and Cell Phys., v 45, No. 2, pp. 221-224. (Year: 2004).
All Office Actions; U.S. Appl. No. 17/895,570, filed Aug. 25, 2022.
U.S. Unpublished U.S. Appl. No. 17/895,570, filed Aug. 25, 2022 to Raul Victorino Nunes et al.

Acid Treated Acid plus Enzyme Treated

Acid Treated Acid plus Enzyme Treated

12 Mesh Retain 120 Mesh Retain

FIBROUS STRUCTURES COMPRISING TRICHOME COMPOSITIONS AND METHODS FOR OBTAINING SAME

CROSS REFERENCE TO RELATED APPLICATIONS

This application is a continuation of, and claims priority under 35 U.S.C. § 120 to, U.S. patent application Ser. No. 16/452,582, filed on Jun. 26, 2019, which claims the benefit, under 35 USC § 119(e), of U.S. Provisional Patent Application Ser. No. 62/691,854, filed on Jun. 29, 2018, the entire disclosures of which are fully incorporated by reference herein.

FIELD OF THE INVENTION

The present invention relates to fibrous structures and more particularly to fibrous structures comprising trichomes, for example novel trichome compositions, methods for obtaining such novel trichome compositions, and method for making such fibrous structures.

BACKGROUND OF THE INVENTION

Historically, fibrous structures, such as fibrous structures that are used to make sanitary tissue products, for example toilet tissue, have been made with softwood fibers and hardwood fibers. For example, softwood fibers have typically made up greater than 20% by weight on a dry fiber basis of through-air-dried fibrous structures. The softwood fibers are longer fibers than the hardwood fibers and they provide greater strength properties to the fibrous structures than do the hardwood fibers. However, softwood fibers negatively impact the softness of the fibrous structures.

Formulators have for years attempted to balance the level of softwood fibers in their fibrous structures to ensure adequate strength of the fibrous structures while at the same time trying to minimize the level of softwood fibers to avoid negatively impacting the softness of the fibrous structures. The problem has been that formulators have been unable to reliably make fibrous structures, especially through-air-dried ("TAD") fibrous structures that are used to make sanitary tissue products that contain less than 20% by weight of softwood fibers on a dry fiber basis of the fibrous structure, due to lower resulting strength in the fibrous structures which can lead to product quality issues and/or sheet breaks during processing. If formulators use less than 20% by weight on a dry fiber basis of softwood fibers to make fibrous structures and/or sanitary tissue products, the softwood fibers would need to have excessive refining and/or chemical strength agents to achieve the desired level of strength needed for product quality and/or reliability (avoid sheet breaks during making and/or processing). Both of these actions negatively impact softness of the fibrous structure and/or sanitary tissue product.

In addition to the strength negatives associated with inclusion of high levels of softwood fibers, high levels of hardwood fibers, especially in the outer layers and/or on the outer surfaces of fibrous structures creates negatives relating to lint. Thus, there is a contradiction that formulators have been attempting to balance; namely, too much softwood fibers negatively impacts softness but increases strength whereas too much hardwood fibers negatively impacts strength and increase lint but increases softness.

The problem faced by formulators is how to achieve increased softness and higher strength without negatively impacting the lint (increasing the lint to undesirable levels for consumers of the fibrous structures).

Accordingly, there is a need for a fibrous structure that exhibits increased softness without negatively impacting the lint (increasing the lint too much if at all), and optionally increasing the strength (or at a minimum not decreasing the strength below suitable levels for consumers), fibrous compositions for making such fibrous structures, methods for obtaining such fiber compositions, and methods for making such fibrous structures.

SUMMARY OF THE INVENTION

The present invention fulfills the needs described above by providing a fibrous structure comprising a novel trichome composition comprising a plurality of trichomes, for example non-tetrahydrocannabinol (THC)-containing trichomes, novel trichome compositions, methods for making such fibrous structures, and methods for obtaining such novel trichome compositions.

One solution to the problem identified above; namely, the solution of achieving increased softness without negatively impacting the lint and optionally increasing the strength (or at a minimum not decreasing the strength below suitable levels for consumers, is a fibrous structure comprising a plurality of trichomes, for example a plurality of non-THC-containing trichomes, and/or a novel trichome composition comprising a plurality of trichomes, for example a plurality of non-THC-containing trichomes, and/or a plurality of fibers, for example pulp fibers, such as trichomes, for example non-THC-containing trichomes, and optionally, wood pulp fibers, such as hardwood pulp fibers and/or softwood pulp fibers, wherein the trichomes exhibit one or more of the following characteristics:

in the case of non-THC-containing trichomes, for example trichomes obtained from a plant in the *Stachys* genus, such as a plant *Stachys byzantina* (also commonly referred to a Lamb's Ear), the non-THC-containing trichomes and/or non-THC-containing trichomes within a trichome composition and/or non-THC-containing trichomes within a fiber composition (for example fiber slurry) comprising the non-THC-containing trichomes, the non-THC-containing trichomes exhibit one or more of the following characteristics:

a. a Fiber Length distribution such that greater than 0.1% of the non-THC-containing trichomes exhibit lengths in the range of 3.20 mm to 7.60 mm;

b. a Fiber Length distribution such that less than 2.50% of the non-THC-containing trichomes exhibit lengths in the range of 0.00 mm to 0.20 mm;

c. a % Curl of the non-THC-containing trichomes of greater than 14.25% as measured according to the % Curl Test Method; and d. a % Hydrophobe Extracted from the non-THC-containing trichomes of greater than 1.80% and/or greater than 1.85% as measured according to the % Hydrophobe Extracted Test Method; and in the case of trichomes in general, for example trichomes obtained from a plant in the *Stachys* genus, such as a plant *Stachys byzantina* (also commonly referred to a Lamb's Ear), the trichomes and/or trichomes within a trichome composition and/or trichomes within a fiber composition (for example fiber slurry) comprising the trichomes, the trichomes exhibit one or more of the following characteristics:

a. a Fiber Length distribution such that greater than 0.2% of the trichomes exhibit lengths in the range of 3.20 mm to 7.60 mm;

b. a Fiber Length distribution such that less than 1.00% of the trichomes exhibit lengths in the range of 0.00 mm to 0.20 mm;

c. a % Curl of the trichomes of greater than 15.00% as measured according to the % Curl Test Method; and d. a % Hydrophobe Extracted from the trichomes of greater than 2.10% as measured according to the % Hydrophobe Extracted Test Method.

In one example of the present invention, a fibrous structure comprising a plurality of non-tetrahydrocannabinol (THC)-containing trichomes wherein the non-THC-containing trichomes exhibit one or more of the following characteristics:

a. a Fiber Length distribution such that greater than 0.1% of the non-THC-containing trichomes exhibit lengths in the range of 3.20 mm to 7.60 mm;

b. a Fiber Length distribution such that less than 2.50% of the non-THC-containing trichomes exhibit lengths in the range of 0.00 mm to 0.20 mm;

c. a % Curl of the non-THC-containing trichomes of greater than 14.25% as measured according to the % Curl Test Method; and d. a % Hydrophobe Extracted from the non-THC-containing trichomes of greater than 1.80% and/or greater than 1.85% as measured according to the % Hydrophobe Extracted Test Method is provided.

In another example of the present invention, a non-tetrahydrocannabinol (THC)-containing trichome composition comprising a plurality of non-THC-containing trichomes, wherein the non-THC-containing trichome composition exhibits one or more of the following characteristics:

a. a Fiber Length distribution such that greater than 0.1% of the non-THC-containing trichomes exhibit lengths in the range of 3.20 mm to 7.60 mm;

b. a Fiber Length distribution such that less than 2.50% of the non-THC-containing trichomes exhibit lengths in the range of 0.00 mm to 0.20 mm;

c. a % Curl of the non-THC-containing trichomes of greater than 14.25% as measured according to the % Curl Test Method; and d. a % Hydrophobe Extracted from the non-THC-containing trichomes of greater than 1.80% and/or greater than 1.85% as measured according to the % Hydrophobe Extracted Test Method is provided.

In yet another example of the present invention, a fibrous structure comprising a plurality of trichomes wherein the trichomes exhibit one or more of the following characteristics:

a. a Fiber Length distribution such that greater than 0.2% of the trichomes exhibit lengths in the range of 3.20 mm to 7.60 mm;

b. a Fiber Length distribution such that less than 1.00% of the trichomes exhibit lengths in the range of 0.00 mm to 0.20 mm;

c. a % Curl of the trichomes of greater than 15.00% as measured according to the % Curl Test Method; and d. a % Hydrophobe Extracted from the trichomes of greater than 2.10% as measured according to the % Hydrophobe Extracted Test Method is provided.

In still another example of the present invention, a trichome composition comprising a plurality of non-THC-containing trichomes, wherein the non-THC-containing trichome composition exhibits one or more of the following characteristics:

a. a Fiber Length distribution such that greater than 0.2% of the trichomes exhibit lengths in the range of 3.20 mm to 7.60 mm;

b. a Fiber Length distribution such that less than 1.00% of the trichomes exhibit lengths in the range of 0.00 mm to 0.20 mm;

c. a % Curl of the trichomes of greater than 15.00% as measured according to the % Curl Test Method; and d. a % Hydrophobe Extracted from the trichomes of greater than 2.10% as measured according to the % Hydrophobe Extracted Test Method is provided.

In even another example of the present invention, a roll, for example a convolutely wound roll of the fibrous structure of the present invention is provided.

In still yet another example of the present invention, a sanitary tissue product, for example a single- or multi-ply sanitary tissue product, such as a single- or multi-ply toilet tissue, comprising the fibrous structure of the present invention is provided.

In even still yet another example of the present invention, a package comprising one or more rolls, for example a convolutely wound roll of the fibrous structure of the present invention is provided.

The present invention provides a fibrous structure that exhibits increased softness without negatively impacting the lint (increasing the lint too much if at all), and optionally increasing the strength (or at a minimum not decreasing the strength below suitable levels for consumers), fibrous compositions for making such fibrous structures, methods for obtaining such fiber compositions, and methods for making such fibrous structures.

DETAILED DESCRIPTION OF THE INVENTION

Definitions

Figure 1:
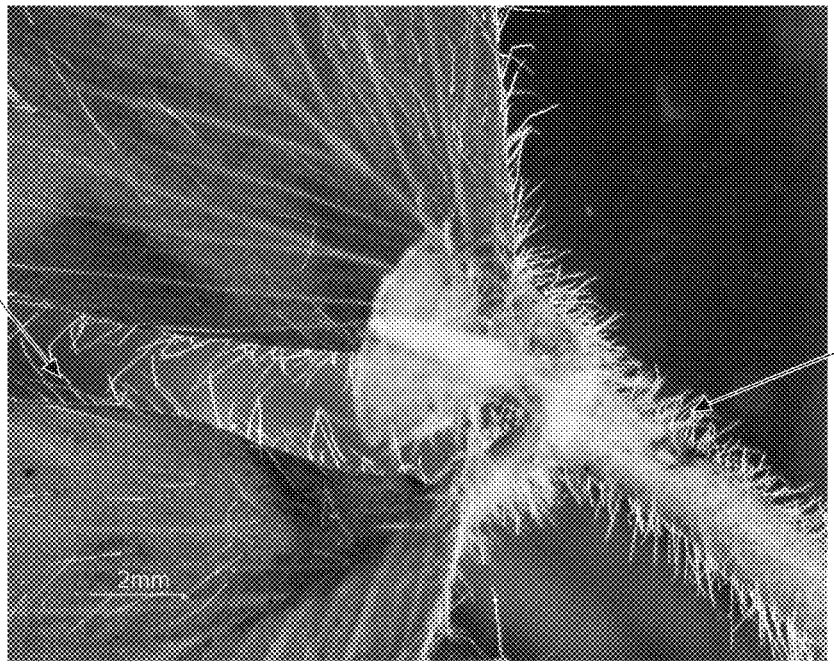
FIG. 1 is a light micrograph of a leaf and leaf stem illustrating trichomes present on red clover, *Trifolium pratense* L.

"Trichome" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one example, the outgrowth is a trichome fiber. The outgrowth may be a hairlike or bristlelike outgrowth from the epidermis of a plant.

Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture.

A trichome may be formed by one cell or many cells.

The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass, for example biomass defined herein, further comprising other materials. Other materials, for example biomass, may include non-trichome-bearing fragments of the host plant.

In one example of the present invention, the individualized trichomes may be classified to enrich the individualized trichome content at the expense of mass, for example biomass, not constituting individualized trichomes.

Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized trichomes may also be used in their physical form, usually fibrous, and herein referred to "trichome fibers", as a component of fibrous structures.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, such as trichome fibers and/or wood pulp fibers, or synthetic fibers, or any other suitable fibers, and any combination thereof.

Natural fibrous structure-making fibers useful in the present invention include animal fibers, mineral fibers, other plant fibers (in addition to the trichomes of the present invention) and mixtures thereof. Animal fibers may, for example, be selected from the group consisting of: wool, silk and mixtures thereof. The other plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Non-limiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Non-limiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); polylactic acids, polyhydroxyalkanoates, polycaprolactones, and mixtures thereof. In one example, synthetic fibers may be used as binding agents.

The web (fibrous structure) of the present invention may comprise fibers, films and/or foams that comprises a hydroxyl polymer and optionally a crosslinking system. Non-limiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a web of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

"Fiber Length", "Average Fiber Length" and "Weighted Average Fiber Length", are terms used interchangeably herein all intended to represent the "Length Weighted Average Fiber Length" as determined for example by means of a Valmet Fiber Image Analyzer—Valmet FS5 commercially available from Valmet, Espoo, Finland. The instructions in the Owner's Manual K12690 V1.2 EN supplied with the unit detail the formula used to arrive at this average. The recommended method for measuring fiber length using this instrument is essentially the same as detailed by the manufacturer in its Owner's Manual. The recommended consistencies for charging to the Fiber Image Analyzer are somewhat lower than recommended by the manufacturer since this gives more reliable operation. Short fiber furnishes, as defined herein, are diluted to 0.02-0.04% prior to charging to the instrument. Long fiber furnishes, as defined herein, are diluted to 0.15-0.30% prior to charging to the instrument. Alternatively, fiber length may be determined by sending the short fibers and/or long fibers to a contract lab, such as Integrated Paper Services, Appleton, Wis.

Fibrous structures may be comprised of a combination of long fibers and short fibers.

Non-limiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Non-limiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

The individualized trichomes used in the present invention may include trichome fibers. The trichome fibers may be characterized as either long fibers or short fibers depending upon their fibers lengths.

"Biomass" as used herein is plant derived material which includes leaves, stems and bracts that exhibit attached trichomes. The plant derived material may be freshly cut or freshly cut and frozen, or refrigerated and contain at least 50% water, or at least 60% water, or at least 70% water, or at least 80% water, or at least 90% water by weight. The plant derived material may be dried and contain less than 50% water, or less than 40% water, or less than 30% water, or less than 20% water, or less than 10% water by weight. The biomass may also contain less than 5% by weight of non-trichome containing plant material from non-target plants that are harvested along with the trichome containing plant material.

"Biomass-Enzyme Suspension" as used herein is a mixture of the aqueous solution into which the Pectinase enzymes have been diluted, and into which the biomass has been added to form a 2-phase solution plus biomass system.

"Bract" as used herein is a modified or specialized leaf, especially one associated with a reproductive structure such as a flower, inflorescence axis, or cone scale.

"Contacting" as used herein means any situation wherein one component has access to another component. Thus, when biomass is contacted with an enzyme, the enzyme has access to the biomass such that it catalyzes a reaction with the biomass. This could occur in a suspension of biomass in an aqueous milieu, but could also occur if a solution containing dissolved enzyme is sprayed onto the biomass, or if dry enzyme is added to the biomass.

"Enzymes" as used herein are proteinaceous molecules capable of catalyzing a chemical reaction. An enzyme may be naturally occurring and utilized as is, or it can be artificially modified in its amino acid sequence or through chemical reactions to improve the catalytic performance for the specific application. An enzyme as used herein may also be comprised of more than one identifiable protein sequence, i.e., a mixture containing more than one enzyme.

"Harvest" or "harvesting" as used herein means a process of gathering mature plants, for example by cutting and then collecting the plants, from a field, which may optionally include moving the plants to a processing operation or storage area.

"Leaves" as used herein are organs of a vascular plant and are the principal lateral appendages of the stem. "Pectin" as used herein is a structural heteropolysaccharide contained in the primary cell walls of terrestrial plants. Pectin consists of a complex set of polysaccharides that are present in most primary cell walls and are particularly abundant in the non-woody parts of terrestrial plants. Pectin is a major component of the middle lamella, where it helps to bind cells together, but is also found in primary cell walls.

"Pectinase" as used herein is any enzyme or mixture of enzymes that catalyze hydrolytic reactions on various forms of pectin. Commercial Pectinase products often contain multiple types of pectin active enzymes such as polygalacturonase (EC 3.2.1.15), Pectin Lyase (EC 4.2.2.10), Pectate Lyase (EC 4.2.2.2), Pectin Methyl Esterase (EC 3.1.1.11), polymethyl galacturonase, (EC 3.2.1.-) and polygalacturonate lyase, (EC 4.2.2.9).

"Pulping" as used herein refers to the wet chemical processes applied used to liberate cellulosic fibers from biomass, typically wood, fiber crops and paper. One type of wet chemical pulping is the Kraft Process which utilizes sodium sulfite, alkali and 170-176° C. water in the reaction. Another type of wet chemical pulping is the Soda Process which utilizes limewater, soda crystals and 178.9° C. water in the reaction. Another type of wet chemical pulping is the sulfite process which utilizes salts of sulfurous acid at pH 1.5-5 and water at 130-160° C. in the reaction.

"Sifting" as used herein means a process that separates and retains coarse parts with a sieve and/or screen allowing less coarse parts to pass through the sieve and/or screen.

"Stem" as used herein means a plant's axis that bears buds and shoots with leaves and, at its basal end, roots. In one example, the stem is the stalk of a plant.

"Fibrous structure" as used herein means a structure that comprises one or more fibers. Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

Non-limiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a trichome in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949, 035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

"Sanitary tissue product" as used herein means a soft, low density (i.e. < about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$ as measured according to the Basis Weight Test Method described herein.

The sanitary tissue products of the present invention may exhibit a total dry tensile of at least 150 g/in and/or from about 200 g/in to about 1000 g/in and/or from about 250 g/in to about 850 g/in as measured according to the Total Dry Tensile Test Method described herein.

In another example, the sanitary tissue product of the present invention may exhibit a total dry tensile of at least 300 g/in and/or at least 350 g/in and/or at least 400 g/in and/or at least 450 g/in and/or at least 500 g/in and/or from about 500 g/in to about 1000 g/in and/or from about 550 g/in to about 850 g/in and/or from about 600 g/in to about 800 g/in as measured according to the Total Dry Tensile Test Method described herein. In one example, the sanitary tissue product exhibits a total dry tensile strength of less than 1000 g/in and/or less than 850 g/in as measured according to the Total Dry Tensile Test Method described herein.

In another example, the sanitary tissue products of the present invention may exhibit a total dry tensile of at least 500 g/in and/or at least 600 g/in and/or at least 700 g/in and/or at least 800 g/in and/or at least 900 g/in and/or at least 1000 g/in and/or from about 800 g/in to about 5000 g/in and/or from about 900 g/in to about 3000 g/in and/or from about 900 g/in to about 2500 g/in and/or from about 1000 g/in to about 2000 g/in as measured according to the Total Dry Tensile Test Method described herein.

"Basis Weight" as used herein is the weight per unit area of a sample reported in lbs/3000 ft$^2$ or g/m$^2$. Basis weight is measured by preparing one or more samples of a certain area (m$^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples (m$^2$) is measured. The basis weight (g/m$^2$) is calculated by dividing the average weight (g) by the average area of the samples (m$^2$).

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

Trichomes (Trichome Compositions)

A variety of plants may be used as the source of trichomes, for example non-THC-containing trichome plants such as non-Cannabis plants, for example Lamb's Ear plants. Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures. Trichomes may have a wide range of morphology and chemical properties. For example, the trichomes may be in the form of fibers; namely, trichome fibers. Such trichome fibers may have a high fiber length to fiber diameter ratio.

The following sources are offered as nonlimiting examples of trichome-bearing plants (suitable sources) for obtaining trichomes, especially trichome fibers.

Nonlimiting examples of suitable sources for obtaining trichomes, especially trichome fibers, are plants in the Labiatae (Lamiaceae) family commonly referred to as the mint family.

Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the Labiatae family include the arcticus subspecies of *Thymus praecox*, commonly referred to as creeping thyme and the *pseudolanuginosus* subspecies of *Thymus praecox*, commonly referred to as wooly thyme.

Further examples of suitable species in the Labiatae family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable species in the Labiatae family include Lavandula lanata, commonly referred to as wooly lavender; *Marrubium vulgare*, commonly referred to as horehound; *Plectranthus argentatus*, commonly referred to as silver shield; and *Plectranthus tomentosa*.

Nonlimiting examples of other suitable sources for obtaining trichomes, especially trichome fibers are plants in the Asteraceae family commonly referred to as the sunflower family.

Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow; *Anaphalis margaritacea*, also known as pearly everlasting; and *Encelia farinose*, also known as brittle bush.

Additional examples of suitable species in the Asteraceae family include *Senecio brachyglottis* and *Senecio haworthii*, the latter also known as *Kleinia haworthii*.

Nonlimiting examples of other suitable sources for obtaining trichomes, especially trichome fibers, are plants in the Scrophulariaceae family commonly referred to as the figwort or snapdragon family.

An example of a suitable species in the Scrophulariaceae family includes *Pedicularis kanei*, also known as the wooly lousewort.

Additional examples of suitable species in the Scrophulariaceae family include the mullein species (*Verbascum*) such as *Verbascum hybridium*, also known as snow maiden; *Verbascum thapsus*, also known as common mullein; *Verbascum baldaccii; Verbascum bombyciferum; Verbascum broussa; Verbascum chaixii; Verbascum dumulsum; Verbascum laciniatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'.

Further examples of suitable species in the Scrophulariaceae family include *Stemodia tomentosa* and *Stemodia durantifolia*.

Nonlimiting examples of other suitable sources for obtaining trichomes, especially trichome fibers include *Greyia radlkoferi* and *Greyia flanmaganii* plants in the Greyiaceae family commonly referred to as the wild bottlebrush family.

Nonlimiting examples of other suitable sources for obtaining trichomes, especially trichome fibers include members of the Fabaceae (legume) family. These include the *Glycine max*, commonly referred to as the soybean, and *Trifolium pratense* L, commonly referred to as medium and/or mammoth red clover. Nonlimiting examples of other suitable sources for obtaining trichomes, especially trichome fibers include members of the Solanaceae family including varieties of *Lycopersicum esculentum*, otherwise known as the common tomato.

Nonlimiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Nonlimiting examples of other suitable sources for obtaining trichomes, especially trichome fibers include members of the Malvaceae (mallow) family, including *Anoda cristata*, commonly referred to as spurred anoda and *Abutilon theophrasti*, commonly referred to as velvetleaf.

Nonlimiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of renardii in the Geraniaceae (geranium) family; the *Tibouchina urvilleana*, commonly referred to as the Brazilian spider flower of the Melastomataceae family; the *Tillandsia recur-*

*vata*, commonly referred to as ballmoss of the Bromeliaceae (pineapple) family; the *Hypericum tomentosum*, commonly referred to as the wooly St. John's wort of the Hypericaceae family; the *Chorizanthe orcuttiana*, commonly referred to as the San Diego spineflower of the Polygonaceae family; *Eremocarpus setigerus*, commonly referred to as the doveweed of the Euphorbiaceae or spurge family; *Kalanchoe tomentosa*, commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, Mass.

In one example, a trichome suitable for use in the fibrous structures of the present invention comprises cellulose.

In yet another example, a trichome suitable for use in the fibrous structures of the present invention comprises a fatty acid. In still another example, a trichome suitable for use in the fibrous structures of the present invention is hydrophobic.

Figure 2:
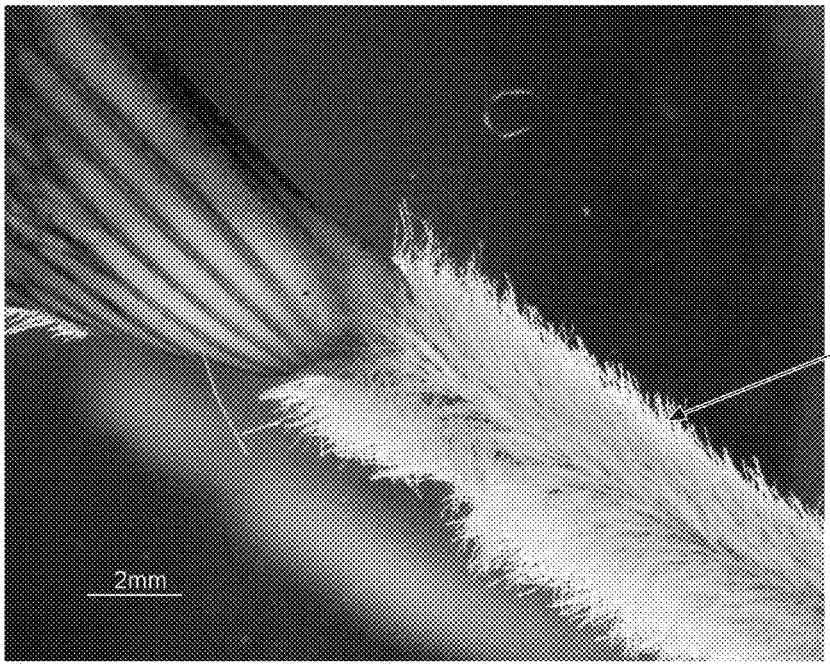
FIG. 2 is a light micrograph of a lower stem illustrating trichomes present on red clover, *Trifolium pratense* L.

As shown in FIG. 1, numerous trichomes 10 are present on this red clover leaf and leaf stem. FIG. 2 shows numerous trichomes 10 present on a red clover lower stem.

Figure 3:
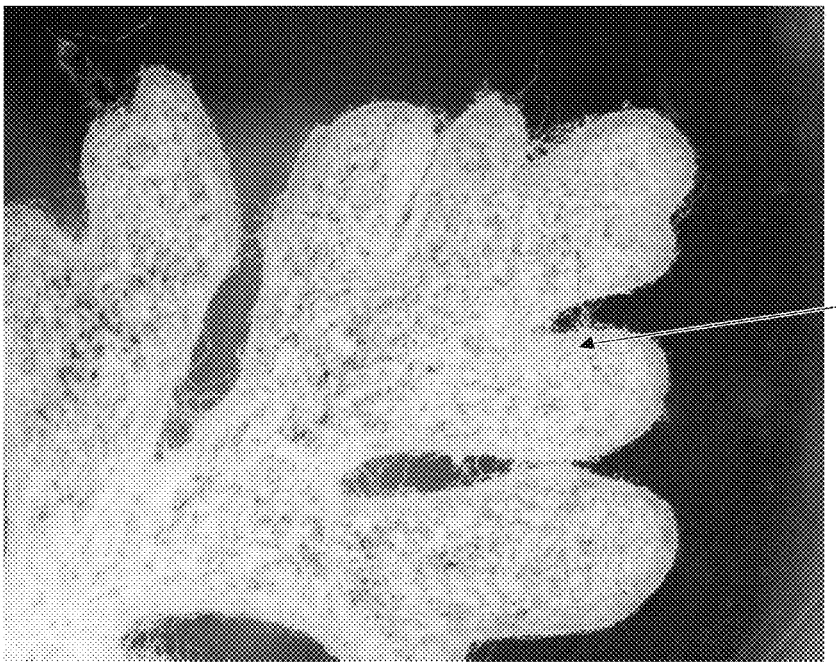
FIG. 3 is a light micrograph of a leaf illustrating trichomes present on dusty miller, *Centaurea gymnocarpa;*
Figure 4:
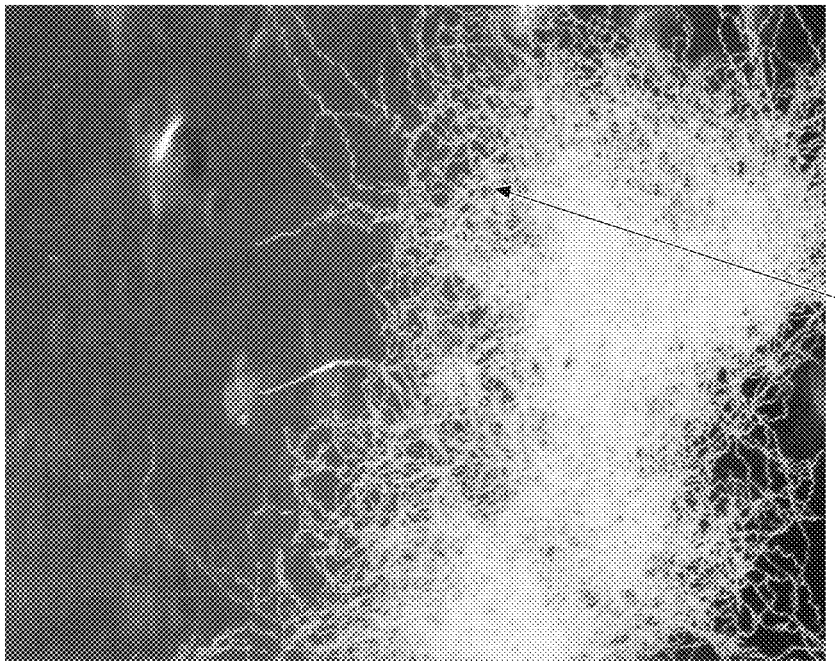
FIG. 4 is a light micrograph of individualized trichomes individualized from a leaf of dusty miller, *Centaurea gymnocarpa;*

As shown in FIG. 3, a dusty miller leaf contains numerous trichomes 10. FIG. 4 shows individualized trichomes 10A obtained from a dusty miller leaf.

Figure 5:
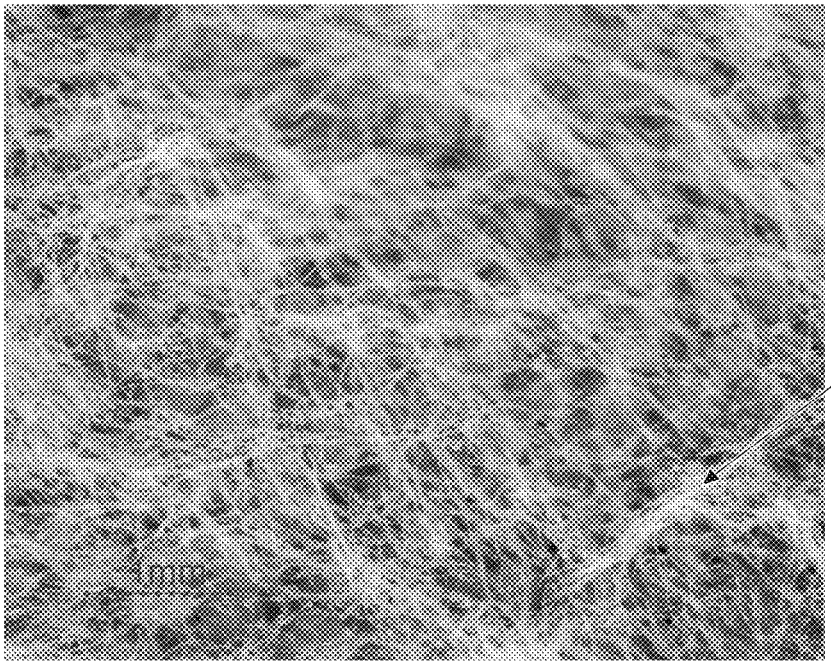
FIG. 5 is a light micrograph of a basal leaf illustrating trichomes present on silver sage, *Salvia argentiae;*
Figure 6:
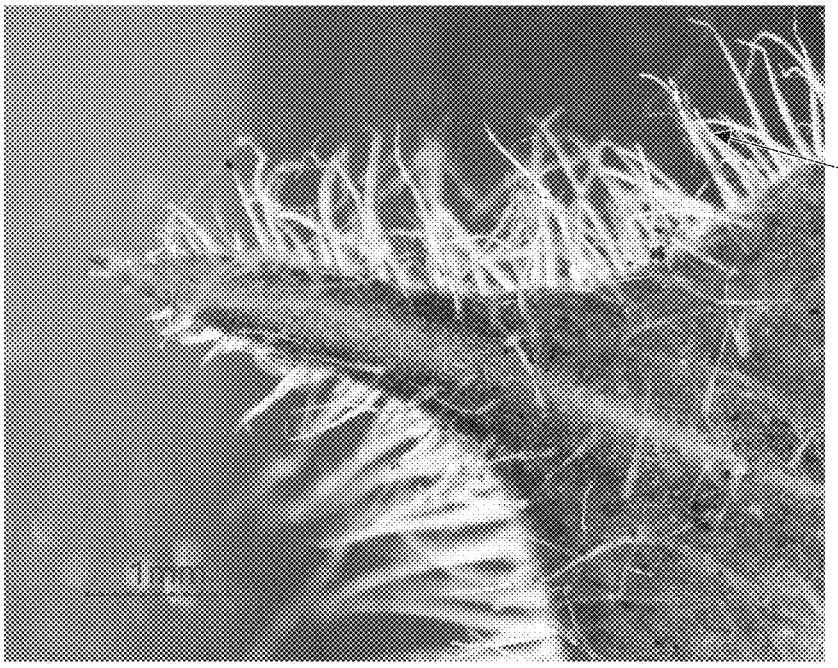
FIG. 6 is a light micrograph of a bloom-stalk leaf illustrating trichomes present in silver sage, *Salvia argentiae;*

As shown in FIG. 5, a basal leaf on a silver sage contains numerous trichomes 10. FIG. 6 shows trichomes 10 present on a bloom-stalk leaf of a silver sage.

Figure 7:
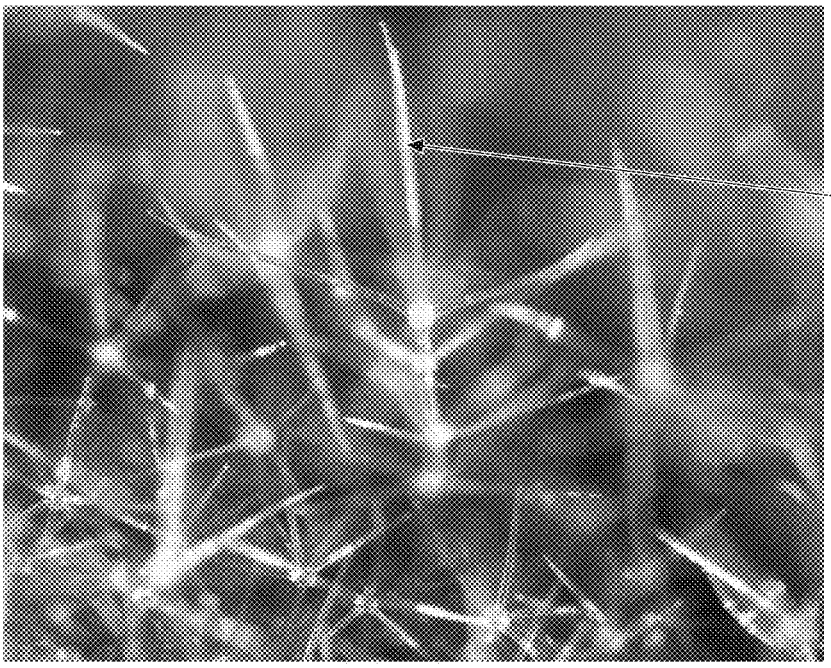
FIG. 7 is a light micrograph of a mature leaf illustrating trichomes present on common mullein, *Verbascum thapsus;*
Figure 8:
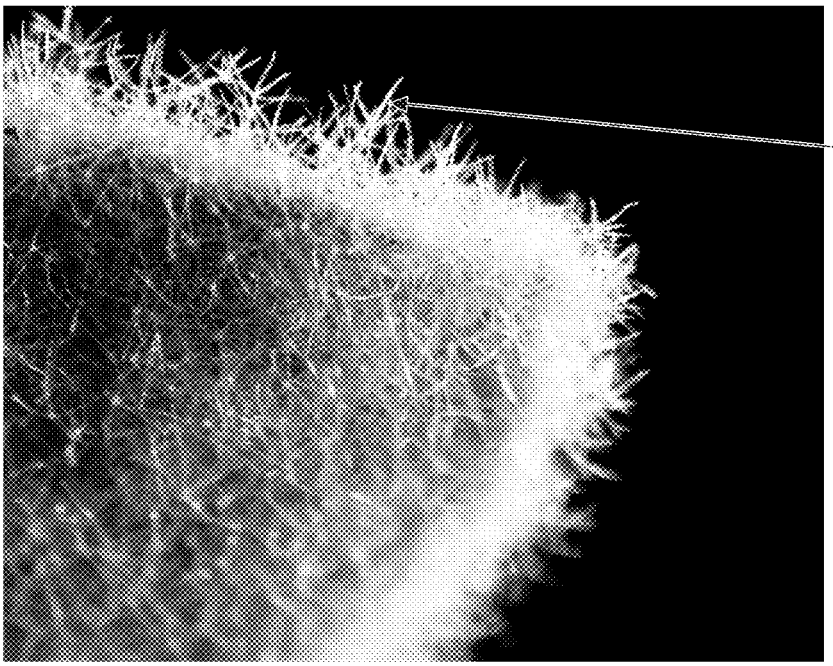
FIG. 8 is a light micrograph of a juvenile leaf illustrating trichomes present on common mullein, *Verbascum thapsus;*

As shown in FIG. 7, trichomes 10 are present on a mature leaf of common mullein. FIG. 8 shows trichomes 10 present on a juvenile leaf of common mullein.

Figure 9:
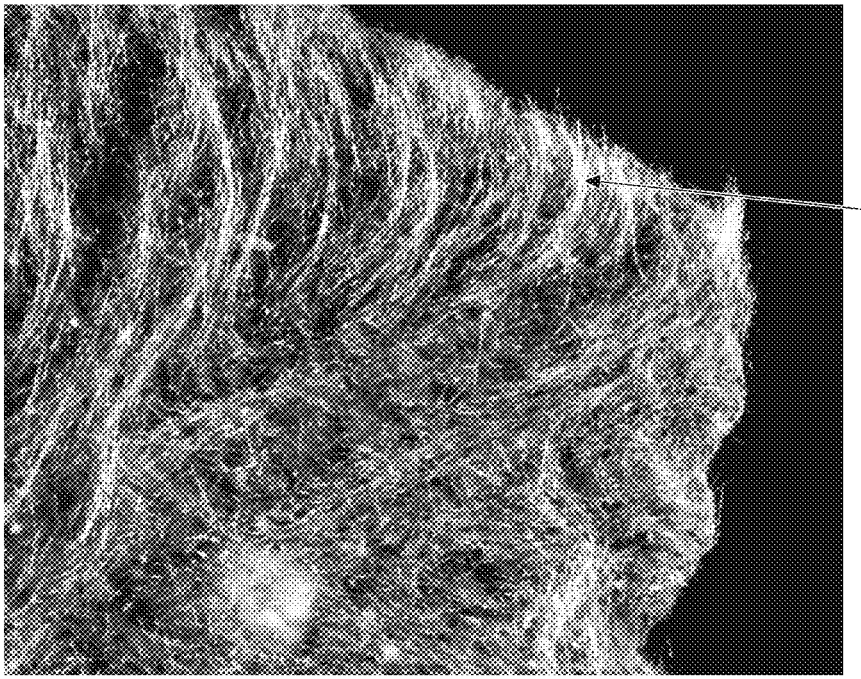
FIG. 9 is a light micrograph of a perpendicular view of a leaf illustrating trichomes present on wooly betony, *Stachys byzantina;*
Figure 10:
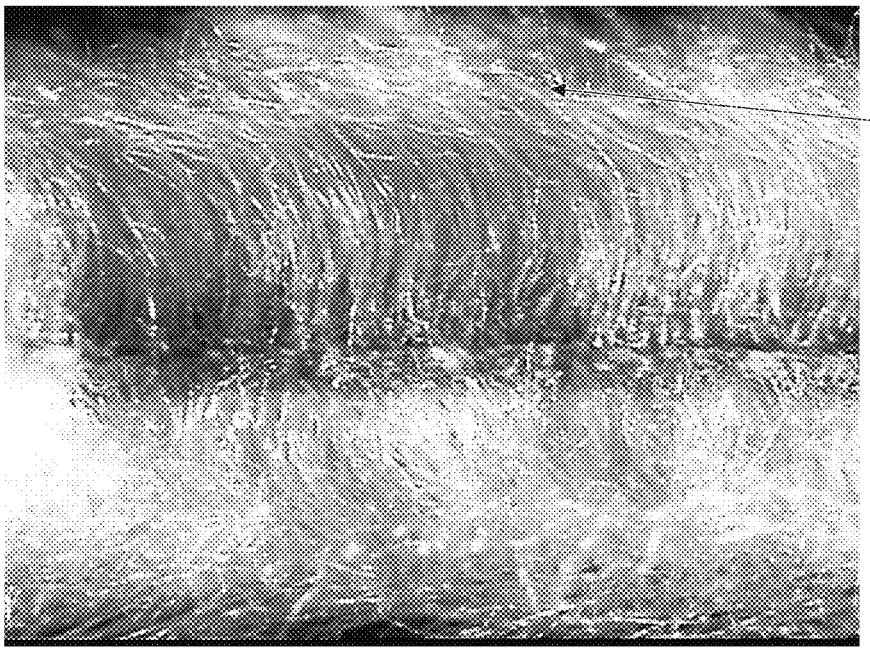
FIG. 10 is a light micrograph of a cross-sectional view of a leaf illustrating trichomes present on wooly betony, *Stachys byzantina;*
Figure 11:
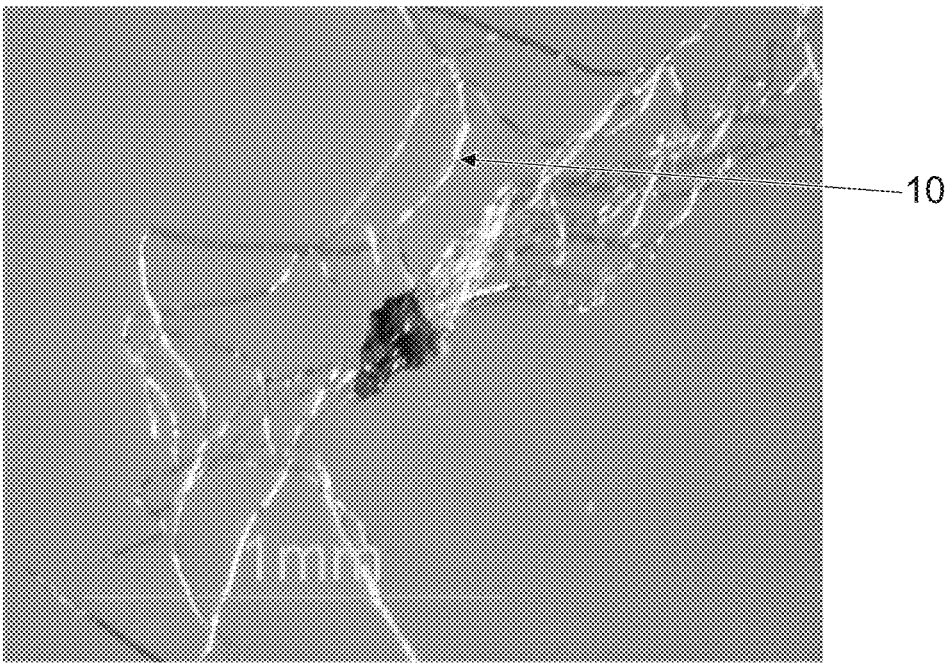
FIG. 11 is a light micrograph of individualized trichomes in the form of a plurality of trichomes bound by their individual attachment to a common remnant of a host plant, wooly betony, *Stachys byzantina;*

FIG. 9 shows, via a perpendicular view, trichomes 10 present on a leaf of wooly betony. FIG. 10 is a cross-sectional view of a leaf of wooly betony containing trichomes 10. FIG. 11 shows individualized trichomes 10A obtained from a wooly betony leaf.

The trichomes, for example non-THC-containing trichomes, obtained from the processes of the present invention, for example non-THC-containing trichomes, and/or a trichome compositions comprising trichomes, for example non-THC-containing trichomes, which may be incorporated into fiber compositions, with or without additional other fibers, for example other pulp fibers such as wood pulp fibers such as hardwood and/or softwood pulp fibers, for example a fiber slurry in the case of a wet-laid fibrous structure-making, for example papermaking, process to make fibrous structures of the present invention comprising such trichomes, for example non-THC-containing trichomes and/or such trichome compositions and/or such fiber compositions.

In one example, the trichomes, for example non-THC-containing trichomes, and/or trichome composition comprising a plurality of trichomes, for example non-THC-containing trichomes, and/or fiber composition comprising a plurality of trichomes, for example non-THC-containing trichomes, exhibit one or more and/or two or more and/or three or more and/or all four of the following characteristics:

a. a Fiber Length distribution such that greater than 0.1% and/or greater than 0.2% and/or greater than 0.5% and/or greater than 1.0% and/or greater than 1.5% and/or greater than 2.0% and/or greater than 2.5% of the non-THC-containing trichomes exhibit lengths in the range of 3.20 mm to 7.60 mm;

b. a Fiber Length distribution such that less than 2.50% and/or less than 2.25% and/or less than 2.00% and/or less than 1.50% and/or less than 1.00% and/or less than 0.75% and/or less than 0.50% and/or less than 0.35% and/or less than 0.25% and/or greater than 0.00% to less than 2.50% of the non-THC-containing trichomes exhibit lengths in the range of 0.00 mm to 0.20 mm;

c. a % Curl of the non-THC-containing trichomes of greater than 14.25% and/or greater than 15.00% and/or greater than 16.00% and/or greater than 17.00% and/or greater than 18.00% and/or greater than 19.00% and/or greater than 20.00% and/or greater than 21.00% and/or greater than 14.25% but less than 30.00% and/or greater than 15.00% but less than 25.00% and/or greater than 16.00% but less than 22.00% as measured according to the % Curl Test Method; and d. a % Hydrophobe Extracted from the non-THC-containing trichomes of greater than 1.80% and/or greater than 1.85% and/or greater than 1.95% and/or greater than 2.05% and/or greater than 2.15% and/or greater than 2.30% and/or greater than 2.55% as measured according to the % Hydrophobe Extracted Test Method.

Table 1 below shows a comparison of the fiber length characteristics, % Curl as measured by the % Curl Test Method, and % Hydrophobe Extracted as measured by the % Hydrophobe Extracted Test Method of trichomes, for example non-THC-containing trichomes, and/or trichome compositions comprising trichomes, for example non-THC-containing trichomes obtained by inventive and prior art processes.

TABLE 1

| Fiber Fraction (%) | Trichomes of the Present Invention (Obtained from Inventive Enzymatic Process using PectineX) | Trichomes of the Present Invention (Obtained from Inventive Enzymatic Process using EI) | Trichomes (Obtained from Prior Art Mechanical Process) | Non-THC-containing Trichomes (Obtained from Prior Art Cryogenic Process) |
|---|---|---|---|---|
| 0.00-0.20 mm | 0.17 | 0.32 | 2.84 | 1.0375 |
| 0.20-0.50 mm | 7.28 | 15.52 | 29.50 | 16.82 |
| 0.50-1.20 mm | 60.50 | 63.28 | 56.59 | 55.8975 |
| 1.20-2.00 mm | 22.72 | 18.02 | 9.98 | 22.28 |
| 2.00-3.20 mm | 6.79 | 2.69 | 1.04 | 3.7775 |
| 3.20-7.60 mm | 2.54 | 0.18 | 0.05 | 0.185 |

Table 2 below shows a comparison of the % Curl as measured according to the % Curl Test Method of trichomes, for example non-THC-containing trichomes, and/or trichome compositions comprising trichomes, for example non-THC-containing trichomes obtained by inventive and prior art processes.

TABLE 2

| Characteristic | Trichomes of the Present Invention (Obtained from Inventive Enzymatic Process using PectineX) | | Trichomes of the Present Invention (Obtained from Inventive Enzymatic Process using EI) | | | | Trichomes (Obtained from Prior Art Mechanical Process) | Non-THC-containing Trichomes (Obtained from Prior Art Cryogenic Process) |
|---|---|---|---|---|---|---|---|---|
| | P4 | P12 | P22 | EI1 | EI10 | EI9 | | |
| % Curl | 20.41 | 19.49 | 20.34 | 17.90 | 17.53 | 21.61 | 14.14 | 14.38 |

Table 3 below shows a comparison of the % Hydrophobe Extracted as measured according to the % Hydrophobe Extracted Test Method of trichomes, for example non-THC-containing trichomes, and/or trichome compositions comprising trichomes, for example non-THC-containing trichomes obtained by inventive and prior art processes.

TABLE 3

| Process | Thimble Load (g) | Round Bottom Flask Tare (g) | Round Bottom Flask After Reflux (g) | DCM Extract (g) | % Hydrophobe Extracted |
|---|---|---|---|---|---|
| Trichomes of the Present Invention (Obtained from Inventive Enzyme Process-No bleach) | 3.05859 | 69.87275 | 69.96088 | 0.08813 | 2.88 |
| Trichomes of the Present Invention (Obtained from Inventive Enzyme Process-No bleach) | 3.30487 | 70.11561 | 70.17205 | 0.05644 | 1.71 |
| Trichomes (Obtained from Prior Art Mechanical Process) | 3.05786 | 70.44458 | 70.50966 | 0.06508 | 2.13 |
| Trichomes (Obtained from Prior Art Mechanical Process-Bleached) | 3.03376 | 69.58759 | 69.65611 | 0.06852 | 2.26 |
| Trichomes of the Present Invention (Obtained from Inventive Enzyme Process-Bleached) | 2.35633 | 72.17241 | 72.2205 | 0.04809 | 2.04 |
| Trichomes of the Present Invention (Obtained from Inventive Enzyme Process-Bleached) | 2.29121 | 73.17866 | 73.23857 | 0.05991 | 2.61 |
| Trichomes (Obtained from Prior Art Mechanical Process-Bleached) | 2.94718 | 87.0862 | 87.1382 | 0.052 | 1.76 |
| Non-THC-containing Trichomes (Obtained from Prior Art Cryogenic Process) | 1.09586 | 60.78613 | 60.80846 | 0.02233 | 2.04 |

In one example, the trichomes and/or trichome composition comprising a plurality of trichomes, and/or fiber composition comprising a plurality of trichomes exhibit one or more and/or two or more and/or three or more and/or all four of the following characteristics:

a. a Fiber Length distribution such that greater than 0.2% and/or greater than 0.5% and/or greater than 1.0% and/or greater than 1.5% and/or greater than 2.0% and/or greater than 2.5% of the trichomes exhibit lengths in the range of 3.20 mm to 7.60 mm;

b. a Fiber Length distribution such that less than 1.00% and/or less than 0.85% and/or less than 0.70% and/or less than 0.60% and/or less than 0.50% and/or less than 0.40% and/or less than 0.35% and/or less than 0.30% and/or less than 0.25% and/or greater than 0.00% to less than 1.00% of the trichomes exhibit lengths in the range of 0.00 mm to 0.20 mm;

c. a % Curl of the trichomes of greater than 15.00% and/or greater than 16.00% and/or greater than 17.00% and/or greater than 18.00% and/or greater than 19.00% and/or greater than 20.00% and/or greater than 21.00% and/or greater than 15.00% but less than 30.00% and/or greater than 16.00% but less than 25.00% and/or greater than 17.00% but less than 22.00% as measured according to the % Curl Test Method; and d. a % Hydrophobe Extracted from the trichomes of greater than 2.10% and/or greater than 2.15% and/or greater than 2.20% and/or greater than 2.30% and/or greater than 2.55% and/or greater than 2.70% and/or greater than 2.80% and/or greater than 2.10% but less than 10.00% and/or greater than 2.10% but less than 5.00% and/or greater than 2.10% but less than 3.00% and/or greater than 2.15% but less than 3.00% as measured according to the % Hydrophobe Extracted Test Method.

For clarity purposes, for a fiber composition comprising trichomes, for example non-THC-containing trichomes, only the trichomes, for example non-THC-containing trichomes, are considered with respect to the one or more characteristics of the present invention. Other non-trichome materials, for example non-trichome fibers such as other pulp fibers, for example wood pulp fibers such as NSK and/or SSK and/or Eucalyptus pulp fibers are not considered during the measurements of the characteristics with respect to the trichomes. Likewise, when measuring the trichomes, for example non-THC-containing trichomes in a fibrous structure and/or sanitary tissue product, such as toilet tissue, other non-trichome materials, for example non-trichome fibers such as other pulp fibers, for example wood pulp fibers such as NSK and/or SSK and/or Eucalyptus pulp fibers are not considered during the measurements of the characteristics with respect to the trichomes.

Processes for Individualizing Trichomes

In one example of the present invention, the plant biomass (biomass) is suspended in a solution, for example an aqueous solution, one or more enzymes are then added to the solution, and the suspension is mixed until the trichomes are released from the stems or the leaves are disrupted thereby releasing the trichomes.

In one example of the present invention, the biomass from the trichome source plant is processed by:

a. suspending the plant biomass in an aqueous mixture at a defined temperature and pH, b.

contacting the plant biomass with one or more enzymes wherein the enzymes effect the release of the trichomes from the biomass, and c. removing individualized trichomes from the mixture.

The aqueous mixture may be comprised of from about 0.5% to about 99% and/or from about 0.5% to about 95% and/or from about 0.5% to about 90% and/or from about 0.5% to about 80% and/or from about 0.5% to about 60% and/or from about 0.5% to about 40% and/or from about 0.5% to about 20% and/or greater than 10% and/or greater than 1% by weight water. The temperature can be kept constant or be varied during the reaction.

To an extent, higher temperatures increase the rate of the reactions, but too high a temperature can inactivate the enzymes, so an upper limit should be determined depending upon the particular enzymes. In one example, the minimum temperature is 10° C. and/or 20° C. and/or 30° C. and/or 35° C. and/or 40° C. and/or 45° C. Some enzymes may be found in nature or engineered to be active at higher temperatures, in which case, in one example, the minimum temperature is 50° C. and/or 60° C. In another example, the maximum temperature is that in which the enzymes remain active for the duration of the reaction.

The pH of the aqueous mixture can be kept constant or can be varied during the reaction. Enzymes typically exhibit maximum activity at a specific pH or pH range. Outside of this range, the rate of the reaction will decline. Too low (acidic) or too high (alkaline) pH can inactivate the enzymes, so the range must be determined depending upon the particular enzymes. Furthermore, the overall rate of the reaction may be dependent upon more than the enzymatic activity, in which case the overall rate of the reaction may be optimized at a pH distinct from what is considered the maximum for the enzyme activity. For the reaction described herein, the pH may be less than 6.0 and/or less than 5.5 and/or less than 5.0 and/or less than 4.5 and/or less than 4.0 and/or less than 3.5 and/or less than or equal to 2.5. The pH may be adjusted by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until trichomes are released from the biomass, such as from stems, and the trichomes released from the biomass in which the non-trichome biomass is degraded. Upon completion of the reaction, the aqueous suspension contains released trichomes, along with trichome free stems and other biomass that is not completely degraded.

The trichomes are then removed and recovered from the suspension in such a way that the remaining non-trichome biomass is separated from the trichomes and the trichomes are separated from the liquid.

In another example of the present invention, the plant biomass is suspended in solution, for example an aqueous solution, the pH is adjusted, and the suspension is mixed until the trichomes are released from the stems or the leaves are disrupted thereby releasing the trichomes. The biomass from the trichome source plant is processed by a. obtaining plant biomass comprising trichomes, b. contacting the plant biomass with an acidic solution at a temperature and pH less than 5.0, wherein the acid effects the release of the trichomes from the biomass, and c. removing individualized trichomes from the biomass.

The aqueous mixture may be comprised of greater than 99% and/or greater than 95% and/or greater than 90% and/or greater than 80% and/or greater than 60% and/or greater than 40% and/or greater than 20% and/or greater than 10% and/or greater than 1% by weight water.

The temperature can be kept constant or be varied during the reaction. Higher temperatures increase the rate of the acid reaction, but too high a temperature can hydrolyze the trichome cellulose, so an upper limit must be determined. In one example, the temperature is greater than 10° C. and/or greater than 20° C. and/or greater than 30° C. and/or greater than 40° C. and/or greater than 50° C. and/or greater than 60° C. and/or greater than 70° C. and/or greater than 80° C.

The pH can be kept constant or can be varied during the reaction. For the reaction described herein, in one example, the pH is less than 5.0 and/or less than 4.0 and/or less than 3.0 and/or less than 2.5 and/or equal to or less than 2.0. The pH may be controlled by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until trichomes are released from the biomass, such as from stems, and the trichomes released from the biomass in which the non-trichome biomass is degraded. Upon completion of the reaction, the aqueous suspension contains released trichomes, along with trichome free stems and other biomass that is not completely degraded.

The trichomes are then removed and recovered from the suspension in such a way that the remaining non-trichome biomass is separated from the trichomes and the trichomes are separated from the liquid.

In another example of the present invention, the plant biomass is suspended in solution, the pH is adjusted, and the suspension is mixed until the trichomes are released from the stems or the leaves are disrupted thereby releasing the trichomes. The biomass from the trichome source plant is processed by a. obtaining plant biomass comprising trichomes, b. contacting the plant biomass with an acidic solution at a temperature and pH less than 5.0, wherein the acid effects the release of the trichomes from the biomass, and c. removing individualized trichomes from the biomass.

The aqueous mixture may be comprised of greater than 99% and/or greater than 95% and/or greater than 90% and/or greater than 80% and/or greater than 60% and/or greater than 40% and/or greater than 20% and/or greater than 10% and/or greater than 1% by weight water.

The temperature can be kept constant or be varied during the reaction. Higher temperatures increase the rate of the acid reaction, but too high a temperature can hydrolyze the trichome cellulose, so an upper limit must be determined. In one example, the temperature is greater than 10° C. and/or greater than 20° C. and/or greater than 30° C. and/or greater than 40° C. and/or greater than 50° C. and/or greater than 60° C. and/or greater than 70° C. and/or greater than 80° C.

The pH can be kept constant or can be varied during the reaction. For the reaction described herein, in one example, the pH is less than 5.0 and/or less than 4.0 and/or less than 3.0 and/or less than 2.5 and/or equal to or less than 2.0. The pH may be controlled by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until trichomes are released from the biomass, such as from stems, and the trichomes released from the biomass in which the non-trichome biomass is degraded. Upon completion of the reaction, the aqueous suspension contains released trichomes, along with trichome free stems and other biomass that is not completely degraded.

This process of the present invention is different from known pulping processes, for example Kraft and/or Soda and/or Sulfite pulping processes. The Kraft and Soda processes are performed at higher temperatures and at alkaline pH. While the sulfite process also utilizes a pH from 1.5-5.0, it only utilizes sulfurous acid salts and at temperatures of 130-160° C., which are much higher than the temperatures associated with the process of the present invention.

The trichomes are then removed and recovered from the suspension in such a way that the remaining non-trichome biomass is separated from the trichomes and the trichomes are separated from the liquid.

In another example of the present invention, the plant biomass is suspended in solution, the pH is adjusted, and the suspension is mixed until the trichomes are released from the stems or the leaves are disrupted thereby releasing the trichomes. The biomass from the trichome source plant is processed by a. obtaining plant biomass comprising trichomes, b. contacting the plant biomass with an acidic solution of pH less than 5.0 and at a temperature wherein the acid effects the release of the trichomes from the biomass, c. adjusting the pH and the temperature, d. one or more enzymes are added and allowed to react, and e. the individualized trichomes are then removed from the suspension.

In one example, the aqueous mixture is comprised of up to 99% and/or up to 95% and/or up to 90% by weight of water.

In one example, the aqueous mixture is comprised of at least 80% and/or at least 60% and/or at least 40% and/or at least 20% and/or at least 10% and/or at least 1% by weight water.

The temperature can be kept constant or be varied during the reaction. Higher temperatures increase the rate of the acid reaction, but too high a temperature can hydrolyze the trichome cellulose, so an upper limit must be determined. In one example, the temperature is greater than 10° C. and/or greater than 20° C. and/or greater than 30° C. and/or greater than 40° C. and/or greater than 50° C. and/or greater than 60° C. and/or greater than 70° C. and/or greater than 80° C.

The pH can be kept constant or can be varied during the reaction. For the reaction described herein, in one example, the pH is less than 4.0 and/or less than 3.5 and/or less than 3.0 and/or less than 2.5 and/or equal to or less than 2.0. The pH may be controlled by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until trichomes are released from the biomass, such as from stems, and the trichomes released from the biomass in which the non-trichome biomass is degraded. Upon completion of the reaction, the aqueous suspension contains released trichomes, along with trichome free stems and other biomass that is not completely degraded.

Enzymatic Addition

The pH and temperature within the process of the present invention may be adjusted to conditions optimal for enzymatic activity. One or more enzymes are added, and the suspension is mixed until the much of the remaining leaves are disrupted.

To an extent, higher temperatures increase the rate of the reactions, but too high a temperature can inactivate the enzymes, so an upper limit must be determined depending upon the particular enzyme. In one example, the temperature is greater than 10° C. and/or greater than 20° C. and/or greater than 30° C. and/or greater than 35° C. and/or greater than 40° C. and/or greater than 45° C. Some enzymes may be found in nature or engineered to be active at higher temperatures, in which case, in one example, the temperature is greater than 50° C. and/or greater than 60° C. In another example, the maximum temperature is that in which the enzymes remain active for the duration of the reaction.

The pH can be kept constant or can be varied during the reaction. Enzymes typically exhibit maximum activity at a specific pH or pH range. Outside of this range, the rate of the reaction will decline. Too low (acidic) or too high (alkaline) pH can inactivate the enzymes, so range must be determined depending upon the particular enzymes. Furthermore, the overall rate of the reaction may be dependent upon more than the enzymatic activity, in which case the overall rate of the reaction may be optimized at a pH distinct from what is considered the maximum for the enzyme activity. For the reaction described herein, in one example, the pH is less than 6.0 and/or less than 5.5 and/or less than 5.0 and/or less than 4.5 and/or less than 4.0 and/or less than 3.5 and/or less than 3.0 and/or less than 2.5. The pH may be controlled by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until much of the remaining non-trichome biomass is degraded, and the trichomes released from the biomass. Upon completion of the reaction, the aqueous suspension contains released trichomes, along with trichome free stems and other biomass that is not completely degraded. The trichomes are then removed and recovered from the suspension in such a way that the remaining non-trichome biomass is separated from the trichomes and the trichomes are separated from the liquid.

In another example of the present invention, the trichomes are removed from the suspension, separated from the remaining non-trichome biomass and recovered. Methods to accomplish this are known in the art and are not limited by those described herein. For example, trichome fibers can be removed from suspension using equipment used in the paper industry such as Pressure Screens (Kadant Black Clawson LLC, Mason, Ohio, USA; Zhengzhou Leizhan Technology Paper Machinery Co., LTD, Dawei Town, Xinmi City, Henan Province, China), hydrocyclones (Kadant Black Clawson LLC, Mason, Ohio, USA; AKW Apparate+Verfahren GmbH, Hirschau, Germany) and Deep Air Flotation (FRC Systems International, Cumming, Ga., USA; Evoqua Water Technologies LLC, Pittsburgh, Pa., USA). Another option is to pass the suspension through a series of screens of decreasing pore size in which stems and undegraded biomass are retained on larger pore screens, whilst the trichomes pass through and are collected onto smaller pore screens. Other methods to remove stems are known such as the grape stem remover used in the wine industry.

NON-LIMITING PROCESS EXAMPLES

Example 1

Demonstration that Pectinases with or without Cellulases Release Trichomes

Leaves, stems and bracts from dried Lamb's Ear were cut into 3-5 mm pieces. The 150 mg of plant material was wetted by adding 0.01% w/v of Triton X-100 in 20 mL of 50 mM potassium phosphate buffer, pH 4.5 in 250 mL shake flasks. Pectinase enzymes were added in the relevant flasks for a total of 200U (100U each of pectinase from Aspergillus niger (Sigma Cat. #17389) and *Aspergillus aculeatus* (Sigma Cat. #P2611), or 200U of the individual pectinase). Where noted, 100U of Trichoderma reseii cellulase (Sigma Cat. #C2730) was added. The experiment was initiated by addition of enzyme. Enzymes were added to the samples, gently swirled to dissolve and distribute the enzymes, and incubated without shaking at 21° C. After incubation for 24 and 48 h, the flasks were vigorously shaken by hand for 1 min before drawing off liquid. Samples were observed for trichome release and the $OD_{600}$ was measured (Table 4). Both a mixture of pectinases, or each individual pectinase, effectively released the trichomes upon shaking, whereas only a small amount of trichomes were released upon incubating in only buffer. These trichomes often presented themselves as entangled globs. Cellulase in combination with pectinases yields a higher $OD_{600}$, but the liquid was more homogeneous than for only pectinase, and may represent degradation of the trichomes and of the biomass.

TABLE 4

| Sample | A. a Pectinase | A. n Pectinase | Cellulase | 24 h $OD_{600}$ | 48 h $OD_{600}$ |
|---|---|---|---|---|---|
| 1 | – | – | – | 0.082 | 0.165 |
| 2 | + | + | – | 0.767 | 1.14 |
| 3 | ++ | – | – | 0.725 | 1.22 |
| 4 | – | ++ | – | 0.550 | 1.25 |
| 5 | – | – | + | 0.256 | 0.520 |
| 6 | + | + | + | 1.22 | 1.82 |

Example 2

Effect of pH on the Enzymatic Processing of Lamb's Ear Trichomes

Figure 12:
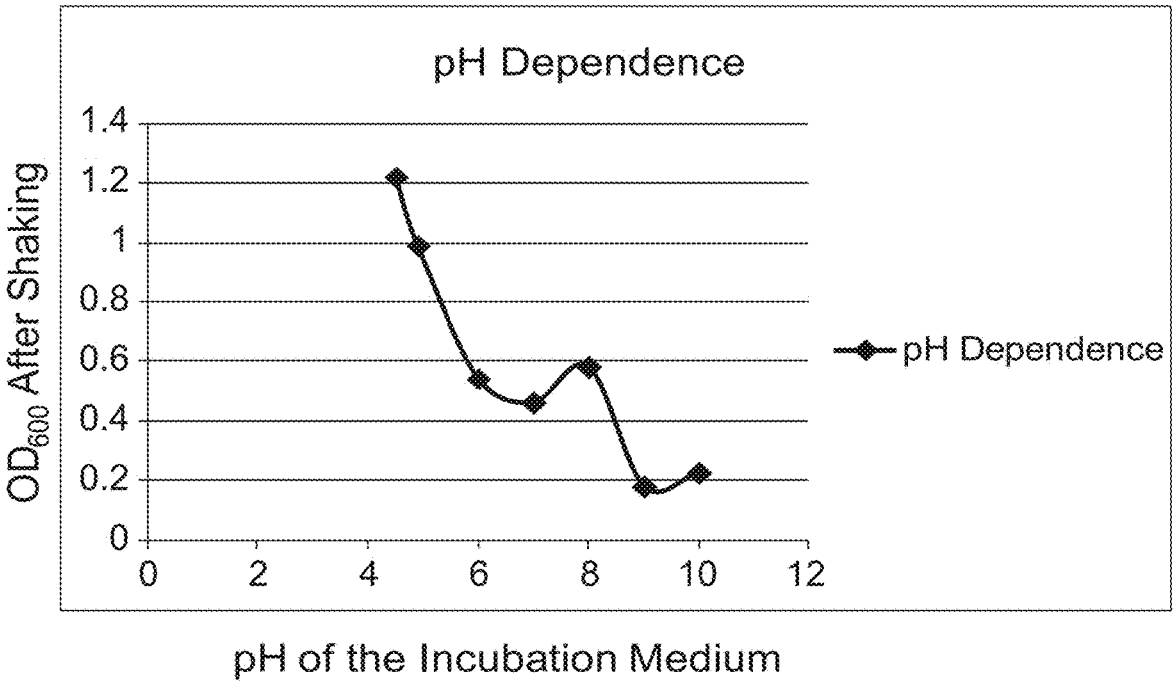
FIG. 12 is a chart demonstrating Pectinase catalyzed release of trichomes from cut, dry biomass vs. pH of the reaction medium.

Leaves, stems and bracts from dried Lamb's Ear were cut into 3-5 mm pieces. The 150 mg of plant material was wetted by adding 0.01% w/v of Triton X-100 in 20 mL of buffer in 250 mL shake flasks. Buffers used were 50 mM potassium phosphate, pH 4.5; 50 mM sodium acetate pH4.9; 80 mM potassium phosphate pH 6.0; 25 mM sodium phosphate pH 7.0; 50 mM Tris HCl pH 8.0; and 50 mM sodium bicarbonate pH 9.0 or 10.0. Samples were incubated at 21° C. for 72 h, the flasks were vigorously shaken by hand for 1 min before drawing off liquid and the $OD_{600}$ measured to determine background release of trichomes without enzyme. At 72 h, 100 Units each of pectinase enzymes *Aspergillus niger* and *Aspergillus aculeatus* were added to the samples. The suspensions were gently swirled to dissolve and distribute the enzymes, and incubated without shaking at 21° C. for 24 h. The flasks were vigorously shaken by hand for 1 min before drawing off liquid, observing for trichome release and measuring the $OD_{600}$ (Table 5). Maximal activity was demonstrated at pH 4.5, and decreased for all higher pH conditions (FIG. 12).

TABLE 5

| Sample pH | $OD_{600}$ 72 h | $OD_{600}$ 96 h |
|---|---|---|
| 4.5 | 0.266 | 1.22 |
| 4.9 | 0.130 | 0.990 |

TABLE 5-continued

| Sample pH | $OD_{600}$ 72 h | $OD_{600}$ 96 h |
|---|---|---|
| 6.0 | 0.190 | 0.542 |
| 7.0 | 0.234 | 0.462 |
| 8.0 | 0.205 | 0.582 |
| 9.0 | 0.188 | 0.180 |
| 10.0 | 0.228 | 0.227 |

Example 3

Enzymatic Processing of Lamb's Ear Trichomes vs. Amount of Enzyme

Figure 13:
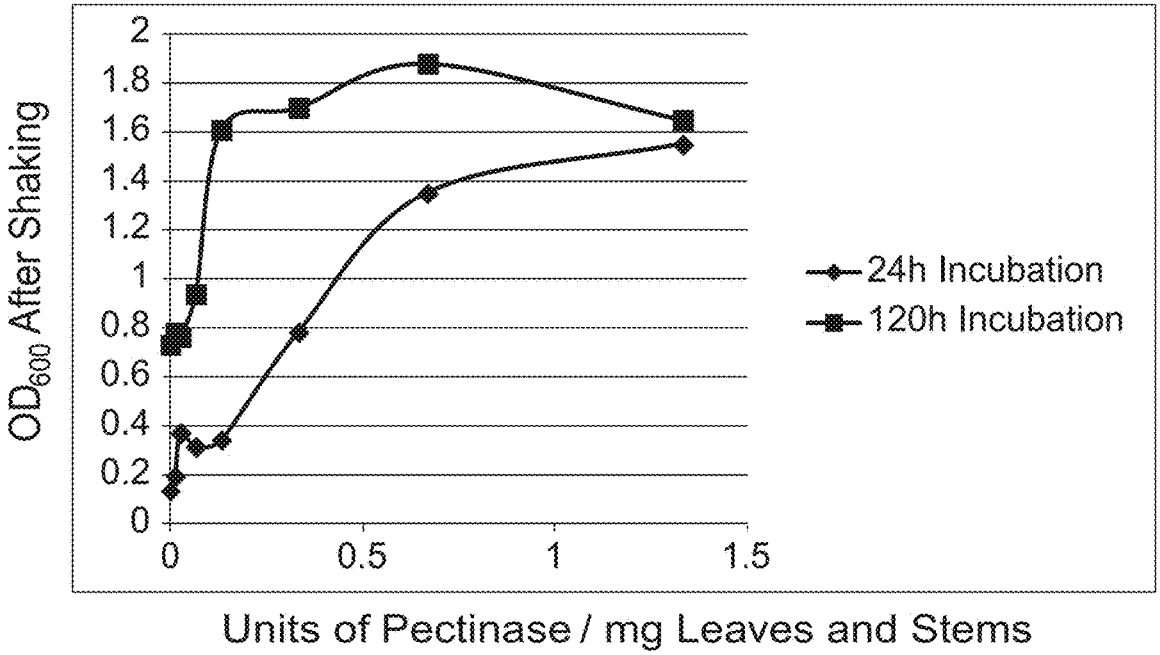
FIG. 13 is a chart demonstrating Pectinase catalyzed release of trichomes from cut, dry biomass vs. amount of enzyme added and time.

Leaves, stems and bracts from dried Lamb's Ear were cut into 3-5 mm pieces. 75 mg of plant material was wetted by adding 0.01% w/v of Triton X-100 in 10 mL of 50 mM potassium phosphate buffer, pH 4.5 in 125 mL shake flasks. *Aspergillus aculeatus* pectinase enzyme was added in the relevant flasks in amounts shown. The experiment was initiated by addition of enzyme. Enzyme was added to the samples, gently swirled to dissolve and distribute the enzyme, and incubated without shaking at 21° C. After incubation for 24 and 120 h, the flasks were vigorously shaken by hand for 1 min before drawing off liquid, observing the sample for trichome release and measuring the $OD_{600}$ (Table 6). Given enough time, as little as 5 units of pectinase (0.067 U/mg leaf/stems) removed some trichomes. As little as 10 Units (0.133 U/mg leaf/stems) gave complete removal (FIG. 13).

TABLE 6

| Sample | Units of Pectinase | Units/mg plant | 24 h $OD_{600}$ | 120 h $OD_{600}$ |
|---|---|---|---|---|
| 1 | 0 | 0 | 0.133 | 0.731 |
| 2 | 1 | 0.013 | 0.194 | 0.780 |
| 3 | 2 | 0.027 | 0.370 | 0.763 |
| 4 | 5 | 0.067 | 0.314 | 0.937 |
| 5 | 10 | 0.133 | 0.342 | 1.61 |
| 6 | 25 | 0.333 | 0.782 | 1.70 |
| 7 | 50 | 0.667 | 1.35 | 1.88 |
| 8 | 100 | 1.33 | 1.55 | 1.65 |

Example 4

Figure 14A:
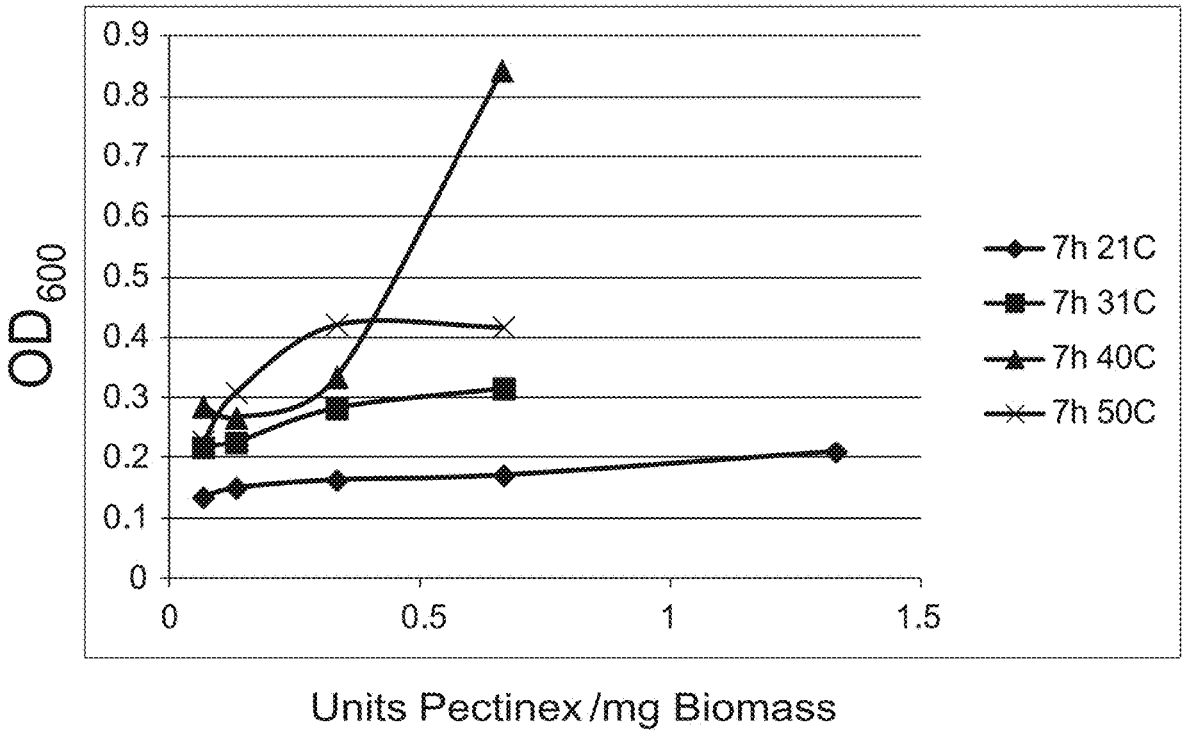
FIG. 14A is a chart demonstrating Pectinase catalyzed release of trichomes from cut, dry biomass at various temperatures of the reaction at 7 hours.
Figure 14B:
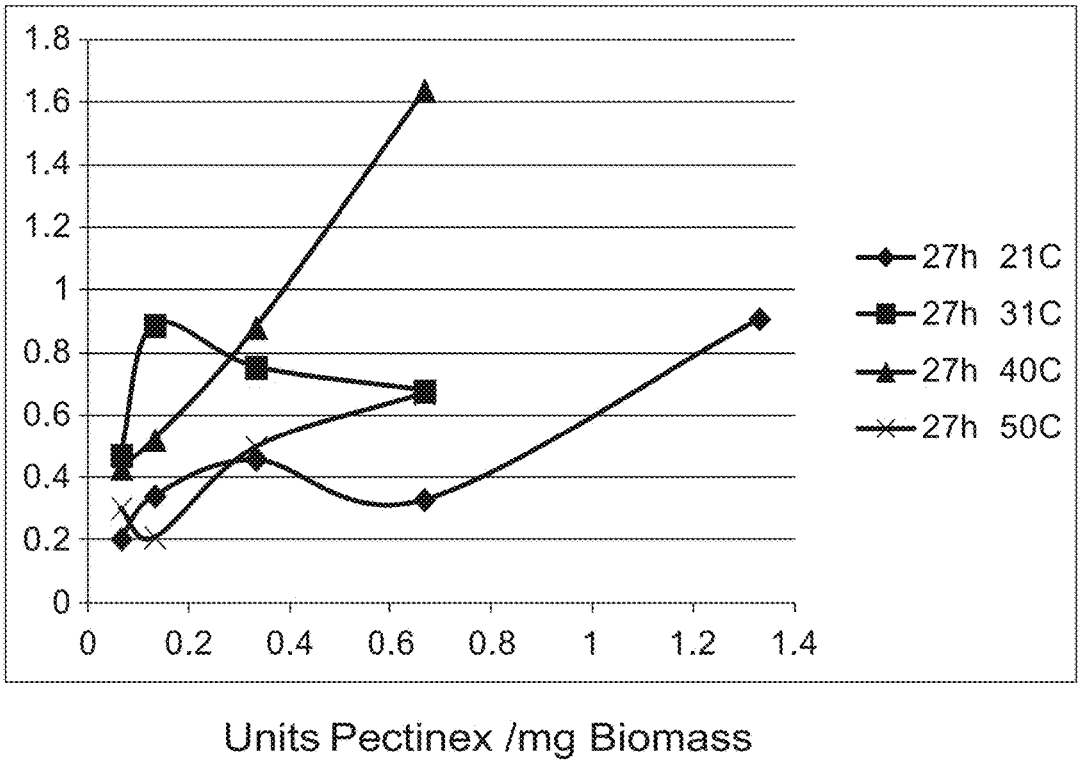
FIG. 14B is a chart demonstrating Pectinase catalyzed release of trichomes from cut, dry biomass vs. time and temperature of the reaction at 27 hours.
Figure 15A:
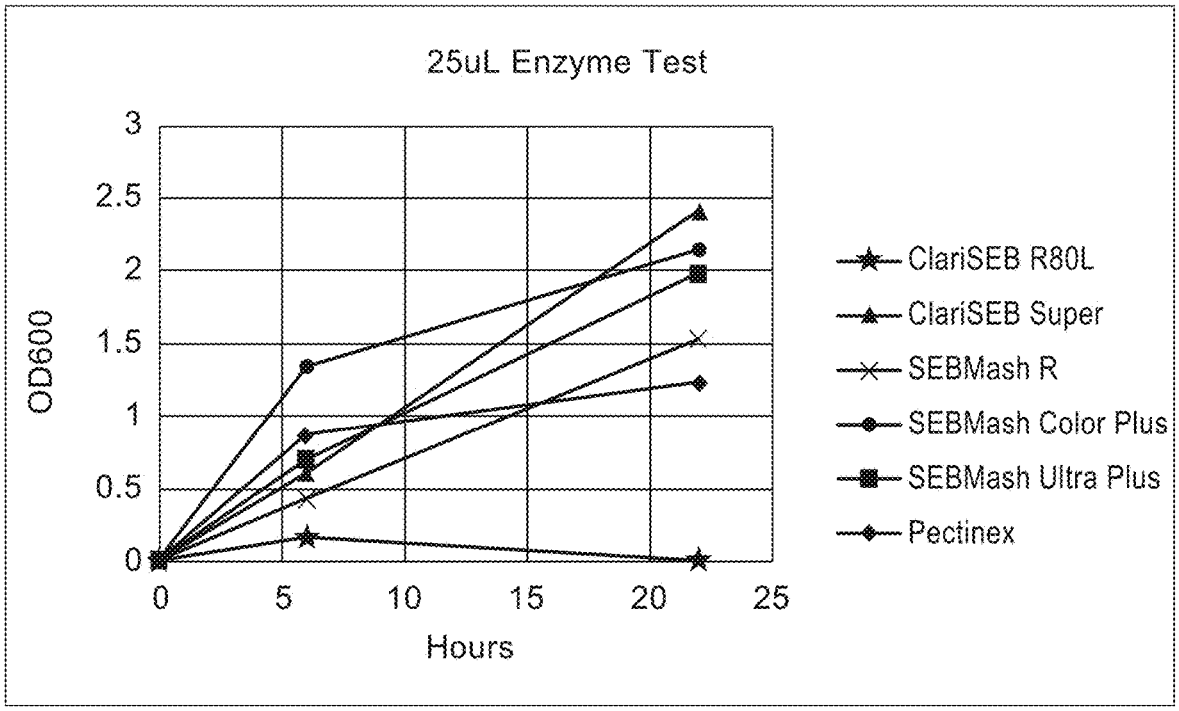
FIG. 15A is a chart demonstrating the potency of trichome release from dried biomass for a variety of Pectinase products at an enzyme level of 25 μL.
Figure 15B:
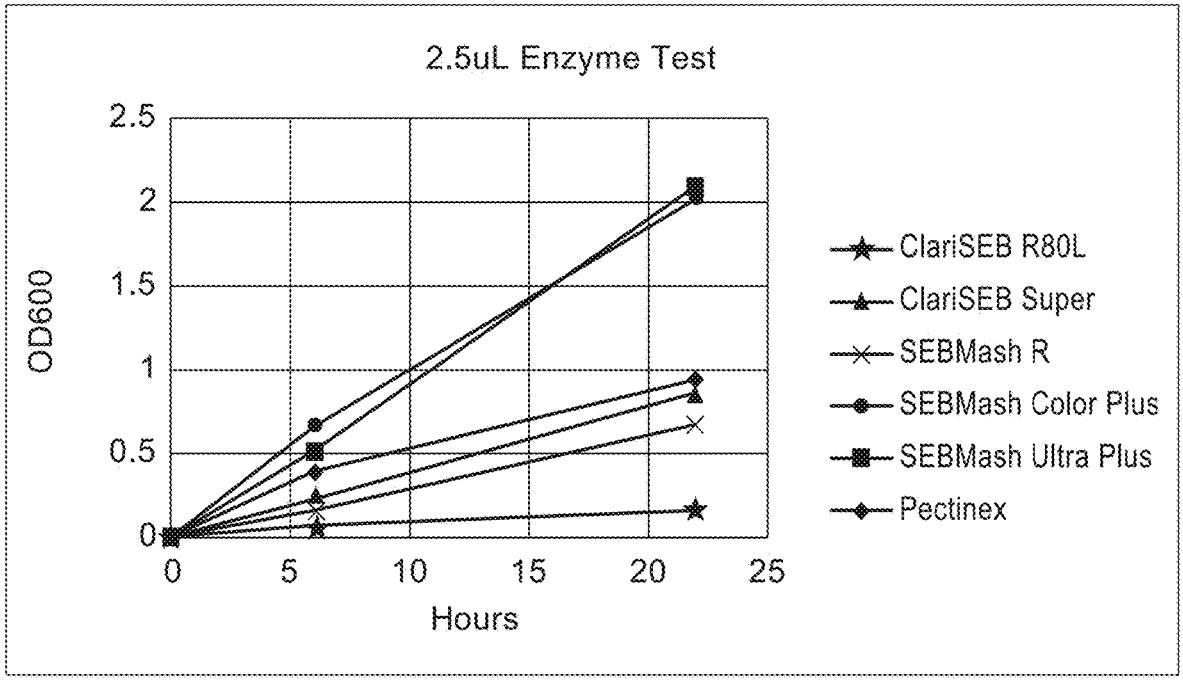
FIG. 15B is a chart demonstrating the potency of trichome release from dried biomass for a variety of Pectinase products at an enzyme level of 2.5 μL.
Figure 15C:
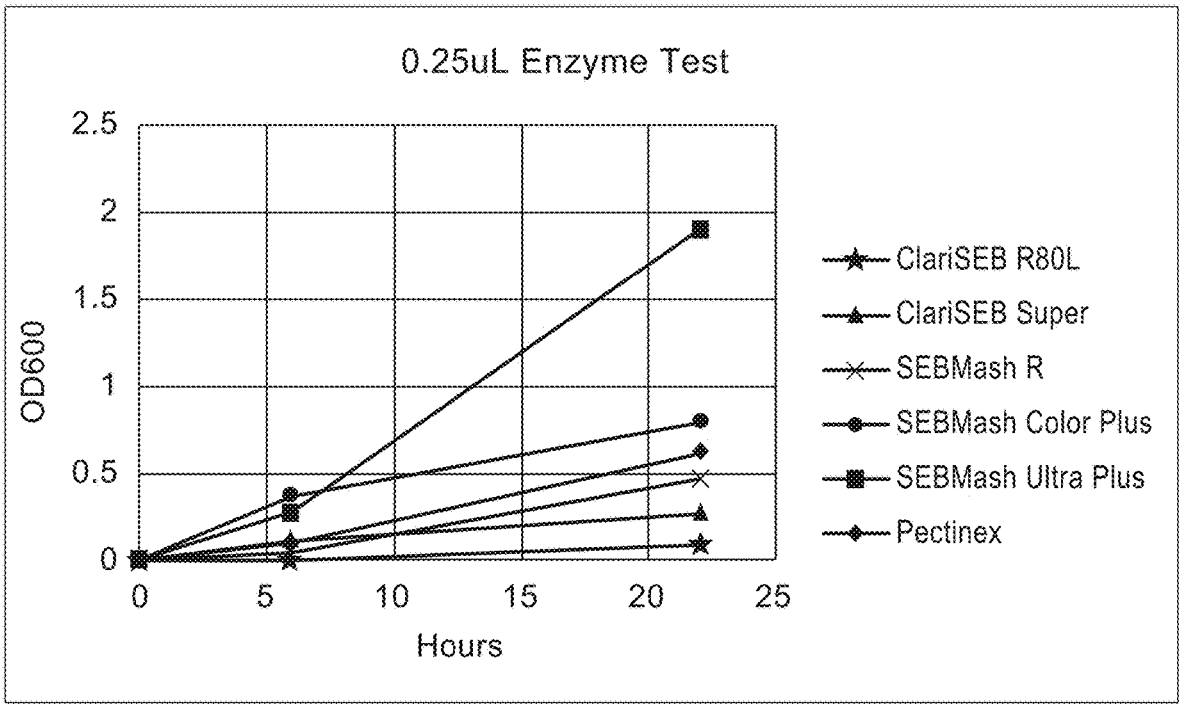
FIG. 15C is a chart demonstrating the potency of trichome release from dried biomass for a variety of Pectinase products at an enzyme level of 0.25 μL.
Figure 15D:
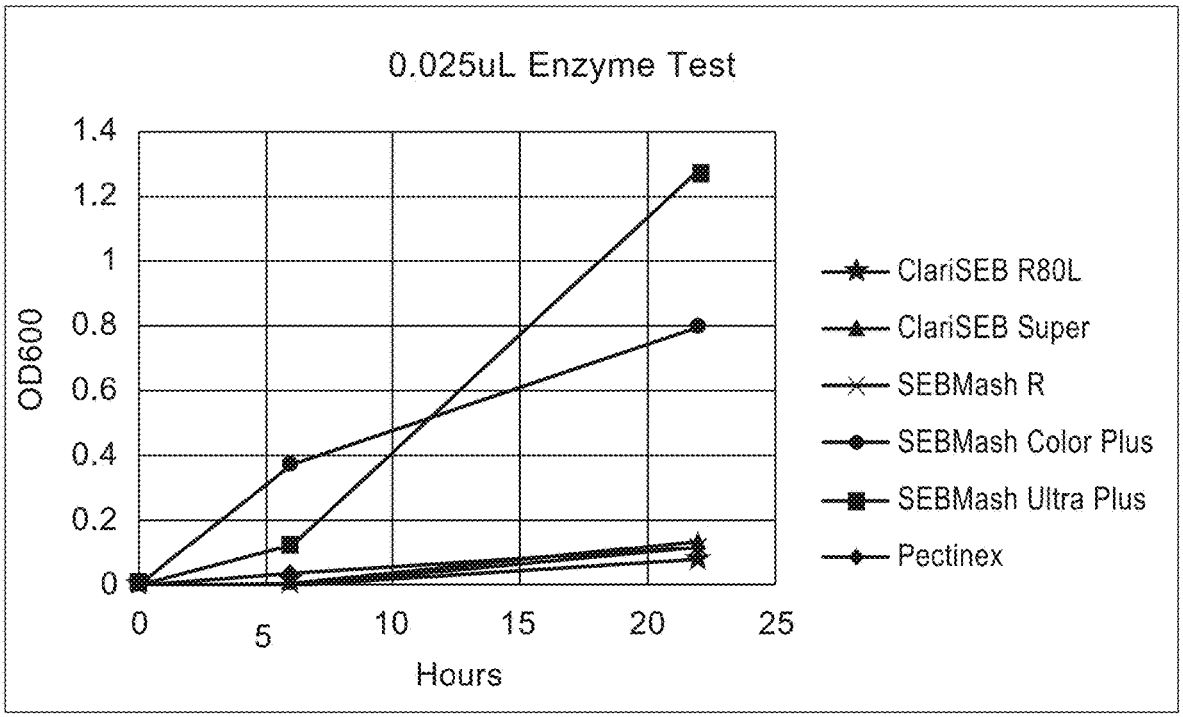
FIG. 15D is a chart demonstrating the potency of trichome release from dried biomass for a variety of Pectinase products at an enzyme level of 0.025 μL.
Figure 15E:
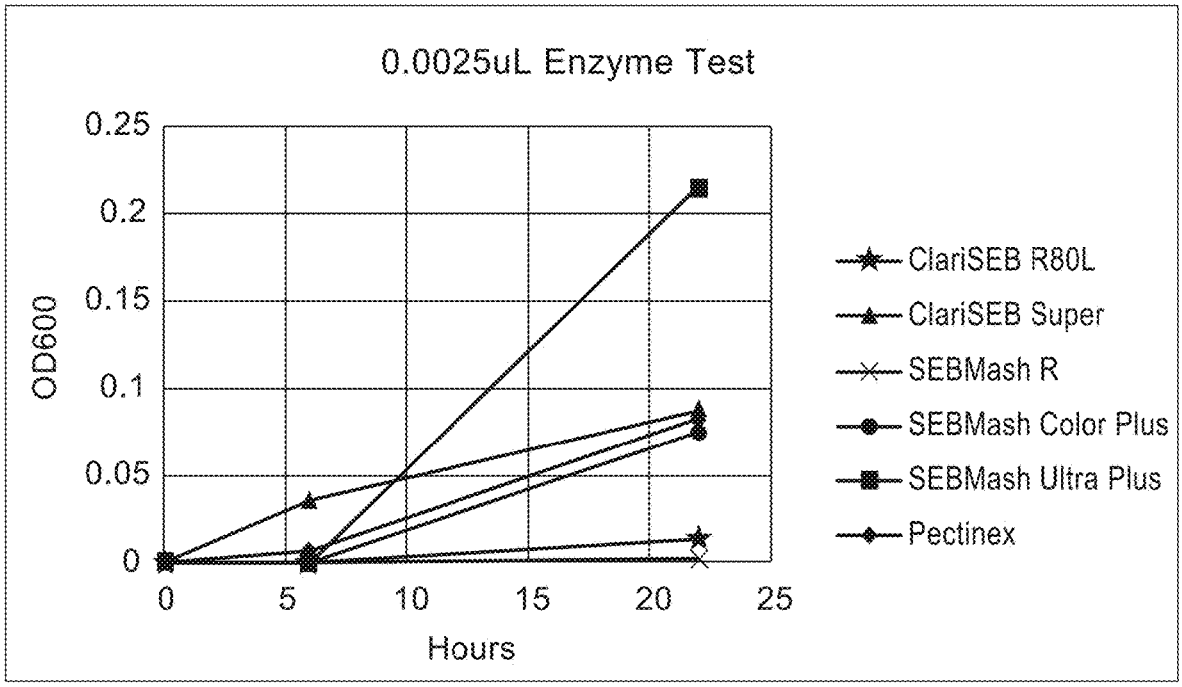
FIG. 15E is a chart demonstrating the potency of trichome release from dried biomass for a variety of Pectinase products at an enzyme level of 0.0025 μL.

Enzymatic Processing of Lamb's Ear Trichomes vs. Amount of Enzyme and Temperature Leaves, stems and bracts from dried Lamb's Ear were cut into 3-5 mm pieces. 75 mg of plant material was wetted by adding 0.01% w/v of Triton X-100 in 10 mL of 50 mM potassium phosphate buffer, pH 4.5 in 125 mL shake flasks. Aspergillus aculeatus pectinase was utilized in the amounts noted. The experiment was initiated by addition of enzyme. Enzyme was added to the temperature equilibrated samples, gently swirled to dissolve and distribute the enzyme, and incubated without shaking at the different temperatures. Analysis of the extent of the reaction was determined at 7 h, then 27 h. The flasks were vigorously shaken by hand for 1 min before pouring off liquid, observing the sample for trichome release and measuring the $OD_{600}$ (Table 7). Increasing temperature to 40° C. sped up the reaction, however, 50° C. decreased the reaction, likely due to denaturation of the enzyme. As the temperature was raised to 40° C., less time was required to get similar extents of reaction (FIGS. 14A and 14B).

TABLE 7

| Sample | Units of Pectinase | Units/mg plant | ° C. | 7 h $OD_{600}$ | 27 h $OD_{600}$ |
|---|---|---|---|---|---|
| 1 | 5 | 0.067 | 21 | 0.135 | 0.205 |
| 2 | 10 | 0.133 | 21 | 0.15 | 0.342 |
| 3 | 25 | 0.333 | 21 | 0.163 | 0.458 |
| 4 | 50 | 0.667 | 21 | 0.171 | 0.330 |
| 5 | 100 | 1.33 | 21 | 0.210 | 0.908 |
| 6 | 5 | 0.067 | 31 | 0.218 | 0.470 |
| 7 | 10 | 0.133 | 31 | 0.226 | 0.887 |
| 8 | 25 | 0.333 | 31 | 0.283 | 0.754 |
| 9 | 50 | 0.667 | 31 | 0.316 | 0.678 |
| 10 | 5 | 0.067 | 40 | 0.286 | 0.430 |
| 11 | 10 | 0.133 | 40 | 0.268 | 0.522 |
| 12 | 25 | 0.333 | 40 | 0.335 | 0.881 |
| 13 | 50 | 0.667 | 40 | 0.843 | 1.64 |
| 14 | 5 | 0.067 | 50 | 0.229 | 0.303 |
| 15 | 10 | 0.133 | 50 | 0.310 | 0.210 |
| 16 | 25 | 0.333 | 50 | 0.422 | 0.497 |
| 17 | 50 | 0.667 | 50 | 0.418 | 0.670 |

Example 5

Multiple Pectinases Release Trichomes

Multiple commercially available Pectinase products were tested for their ability to release trichome trichomes from dried biomass. Biocatalysts, Inc. pectinase preparations 62 L and 831 L were tested. Leaves, stems and bracts from dried Lamb's Ear were cut into 3-5 mm pieces. 75 mg of plant material was wetted by adding 0.01% w/v of Triton X-100 in 10 mL of 50 mM potassium phosphate buffer, pH 4.5 in 125 mL shake flasks. Pectinases 62 L and 831 L were utilized in the amounts noted. The experiment was initiated by addition of enzyme. Enzyme was added to the temperature equilibrated samples, gently swirled to dissolve and distribute the enzyme, and incubated without shaking at the different temperatures. Analysis of the extent of the reaction was determined at 7 h, then 27 h. The flasks were vigorously shaken by hand for 1 min before pouring off liquid, observing the sample for trichome release and measuring the $OD_{600}$ (Table 8)

TABLE 8

| Enzyme | Amount U/mg | Temperature ° C. | $OD_{600}$ 6 h | $OD_{600}$ 22 h |
|---|---|---|---|---|
| None | 0 | 31 | .145 | 0.142 |
| 62L | 1.3 | 31 | .558 | 1.88 |
| 62L | 0.65 | 31 | .746 | 1.17 |
| 62L | 0.13 | 31 | .392 | 0.874 |
| 62L | 0.065 | 31 | .221 | 1.11 |
| 62L | 1.3 | 50 | .728 | 1.17 |
| 62L | 0.65 | 50 | .602 | 1.37 |
| 62L | 0.13 | 50 | .551 | 0.709 |
| 62L | 0.065 | 50 | .346 | 0.571 |
| 831L | 1.3 | 31 | .592 | 1.09 |
| 831L | 0.65 | 31 | .332 | 1.28 |
| 831L | 0.13 | 31 | .317 | 0.78 |
| 831L | 0.065 | 31 | .211 | 0.695 |
| 831L | 1.3 | 50 | .632 | 1.55 |
| 831L | 0.65 | 50 | .396 | 1.01 |
| 831L | 0.13 | 50 | .331 | 0.95 |
| 831L | 0.065 | 50 | .201 | 0.534 |
| None | 0 | 50 | .071 | 0.134 |

Pectinase products from Enzyme Innovations were tested. These products contain combinations of different types of pectin active enzymes (Table 9).

TABLE 9

| Enzyme | Units | Endo-Polygalacturonase (endo-pectinase) | Pectin Lyase | Pectin Methyl-esterase | Hemi-cellulase |
|---|---|---|---|---|---|
| ClariSEB R80L | 80 uPL/g | + | + | + | − |
| ClariSEB Super | 200 uPL/g + 2000 uPOG/g | + | + | − | − |
| SEBMash R | 120,000 PBU/g | + | + | − | + |
| SEBMash Color Plus | 200,000 PBU/g | + | + | + | − |
| SEBMash ultra Plus | 2,500 uPG/g | + | − | + | − |

The pH of the buffer varied for each product and was 4.0 for SEBMash R, SEBMash Color Plus and SEBMash ultra Plus. The buffer was pH 5.3 for ClariSEB R80L and ClariSEB Super, and was pH 4.5 for the Petinex SPL. Incubation at 45° C. without shaking was initiated and samples were processed by shaking for 1 min and analyzed at approximately 6 h and 22 h (Table 10). As measured by $OD_{600}$, the SEBMash Color Plus product appears to be between 10-100× more potent than Pectinex, while the SEBMash ultra Plus may be up to 1,000× more potent. The SEBMash appears about equal to Pectinex, while the ClariSEB products are less potent (FIGS. 15A-15E).

TABLE 10

| Sample | Enzyme | Amount µL | $OD_{600}$ 6 h | $OD_{600}$ 22 h |
|---|---|---|---|---|
| 1 | None | 0 | 0.170 | 0.175 |
| 2 | ClariSEB R80L | 25 | 0.330 | 0.0516 |
| 3 | ClariSEB R80L | 2.5 | 0.236 | 0.336 |
| 4 | ClariSEB R80L | 0.25 | 0.147 | 0.259 |
| 5 | ClariSEB R80L | 0.025 | 0.142 | 0.255 |
| 6 | ClariSEB R80L | 0.0025 | 0.153 | 0.188 |
| 7 | ClariSEB Super | 25 | 0.772 | 2.59 |
| 8 | ClariSEB Super | 2.5 | 0.393 | 1.03 |
| 9 | ClariSEB Super | 0.25 | 0.278 | 0.438 |
| 10 | ClariSEB Super | 0.025 | 0.173 | 0.312 |
| 11 | ClariSEB Super | 0.0025 | 0.205 | 0.262 |
| 12 | SEBMash R | 25 | 0.607 | 1.71 |
| 13 | SEBMash R | 2.5 | 0.329 | 0.850 |
| 14 | SEBMash R | 0.25 | 0.210 | 0.642 |
| 15 | SEBMash R | 0.025 | 0.150 | 0.292 |
| 16 | SEBMash R | 0.0025 | 0.168 | 0.177 |
| 17 | SEBMash Color Plus | 25 | 1.51 | 2.32 |
| 18 | SEBMash Color Plus | 2.5 | 0.835 | 2.20 |
| 19 | SEBMash Color Plus | 0.25 | 0.539 | 0.970 |
| 20 | SEBMash Color Plus | 0.025 | 0.271 | 0.956 |
| 21 | SEBMash Color Plus | 0.0025 | 0.137 | 0.249 |
| 22 | SEBMash ultra Plus | 25 | 0.868 | 2.16 |
| 23 | SEBMash ultra Plus | 2.5 | 0.690 | 2.27 |
| 24 | SEBMash ultra Plus | 0.25 | 0.445 | 2.08 |
| 25 | SEBMash ultra Plus | 0.025 | 0.292 | 1.46 |
| 26 | SEBMash ultra Plus | 0.0025 | 0.146 | 0.390 |
| 27 | Pectinex SPL | 25 | 1.05 | 1.41 |
| 28 | Pectinex SPL | 2.5 | 0.566 | 1.11 |
| 29 | Pectinex SPL | 0.25 | 0.271 | 0.786 |
| 30 | Pectinex SPL | 0.025 | 0.203 | 0.288 |
| 31 | Pectinex SPL | 0.0025 | 0.176 | 0.257 |

Pectawash 20 L, a pectin lyase was tested on 200 mL suspensions of 20 g of Lamb's Ear biomass homogenized in 25 mM Tris-HCl, pH 8.0 in shake flasks at 50° C. The results that are visually observed for the PectaWash 20 L enzyme is that at a volume of >16 µL per liter we can visually see the liberation of trichomes after 2 hours of incubation. Released fiber condensed into "tapioca" sized balls. However, after washing the sample, unlike the light brown/yellow tint of the trichomes from Pectinex preparations, the fiber/biomass mixture had a dark green color.

Other pectin active enzymes such as polymethyl galacturonase, (EC 3.2.1.-) and polygalacturonate lyase, (EC 4.2.2.9) may be used.

Example 6

Enzymatic Release of Trichomes from Biomass in a Stirred Tank Reactor

Figure 16:
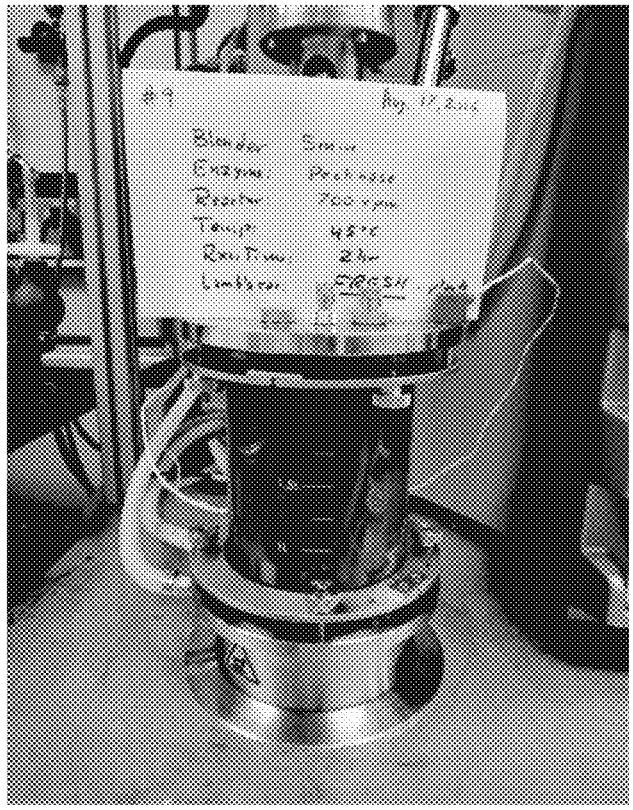
FIG. 16 is a photograph of a fermentor vessel used as a stirred tank reactor for the enzyme catalyzed release of trichomes from homogenized lambs ear.

The enzymatic process detaches trichomes from fresh leaves. In one method, 100.22 g of biomass was first homogenized on high for 5 min in 25 mM sodium citrate, pH 4.5 using a Waring Commercial NuBlend Elite blender. The sample was mixed at 45° C. in a 2 L fermentation vessel (BioFlo), 1.715 mL of Pectinex was added and the reaction was run for 2 h (FIG. 16).

Example 7

Recovery of Trichomes from the Enzyme Processed Biomass

Figure 17:
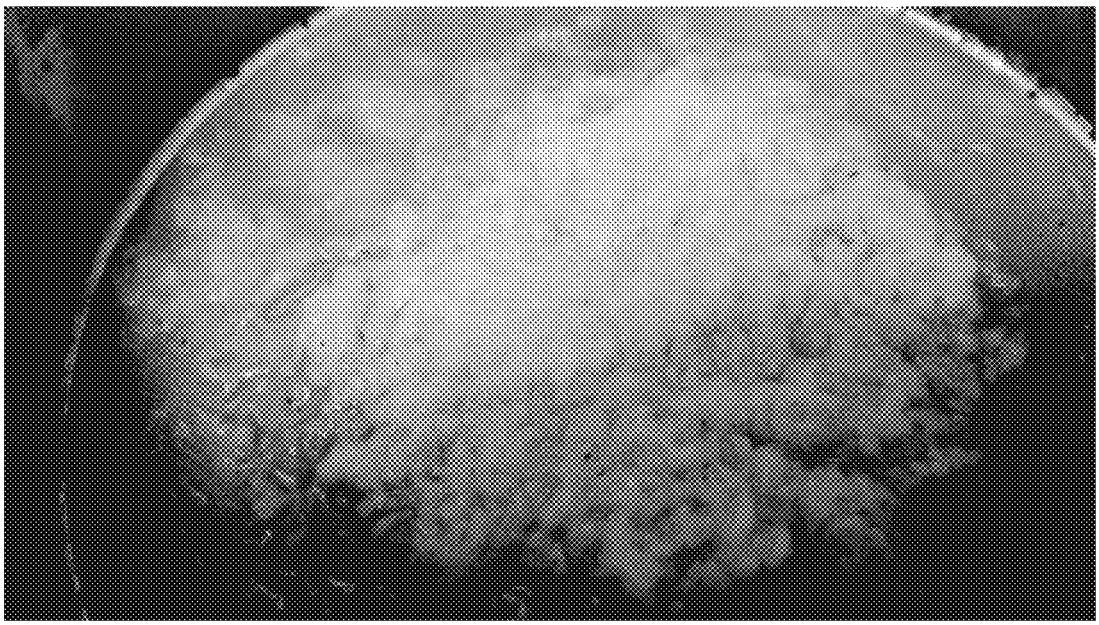
FIG. 17 is a photograph of trichomes recovered from the stirred tank reactor onto a 120 mesh screen.
Figure 18:
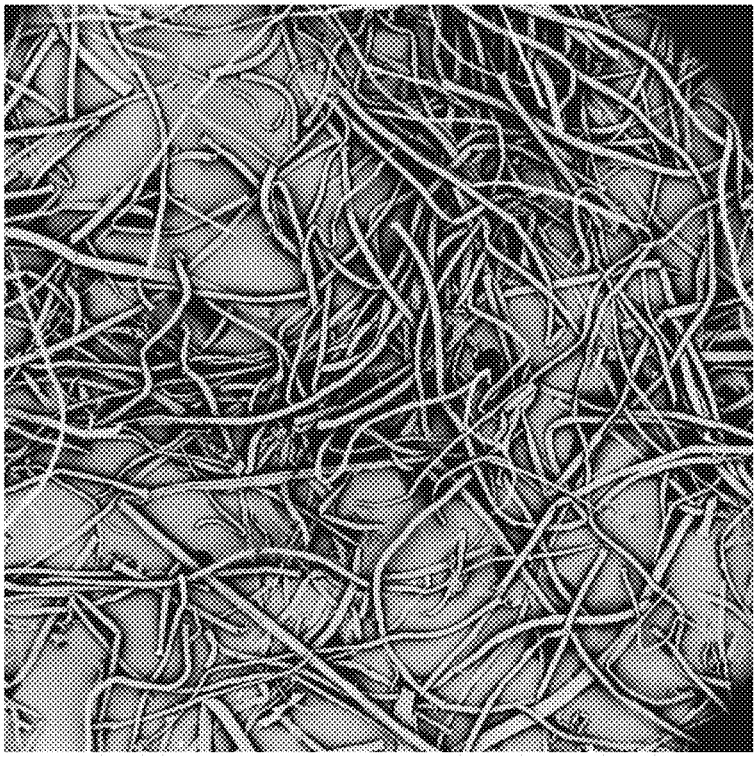
FIG. 18 is a scanning electron microscope image of enzymatically processed trichomes.

The trichomes were recovered and individualized by placing the mixture onto a 50 mesh screen, using a high pressure water spray to force the trichomes through the 50 mesh screen, and collecting the trichomes onto a 120 mesh screen (FIG. 17). Scanning electron microscopy was used to visualize the individualized trichomes (FIG. 18).

Example 8

Scaled up of the Enzymatic Process

Figure 19A:
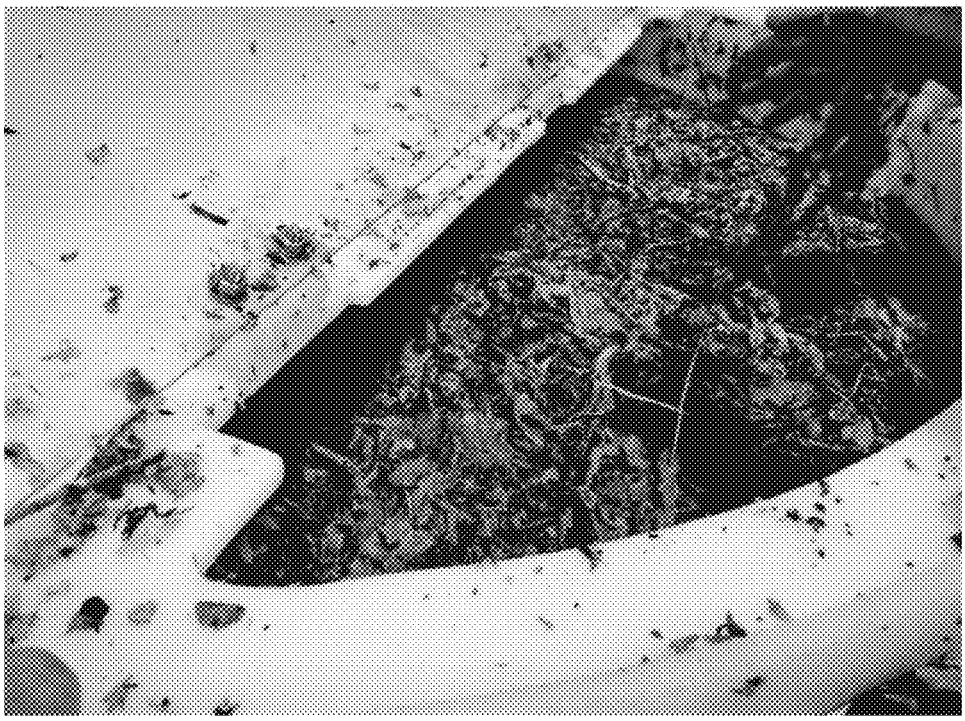
FIG. 19A is a photograph of Lamb's Ear biomass in the 300 gallon stirred tank reactor pre-Pectinase reaction.
Figure 19B:
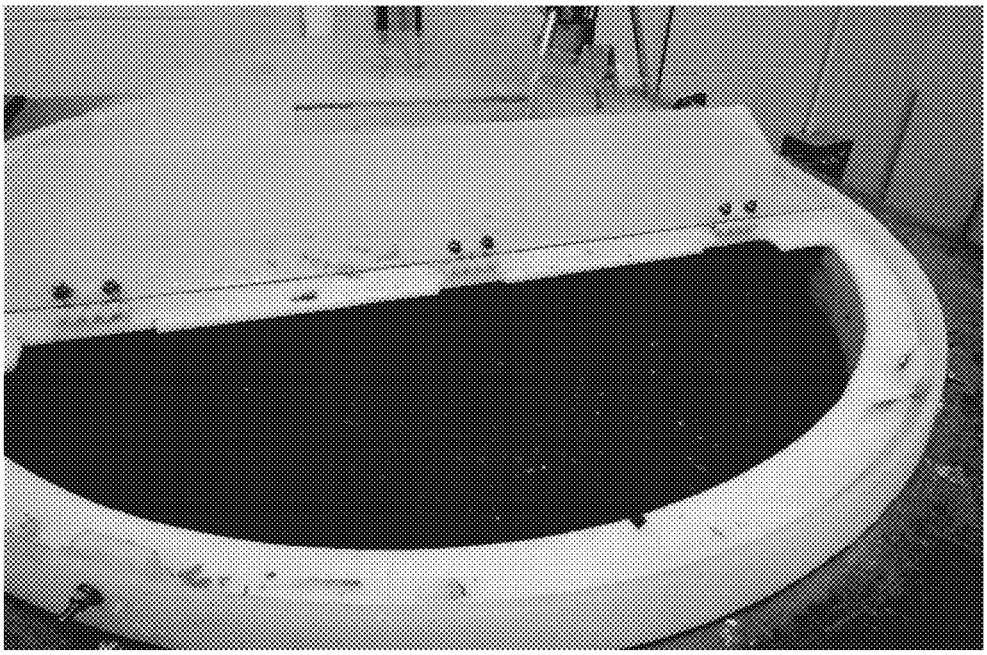
FIG. 19B is a photographs of Lamb's Ear biomass in the 300 gallon stirred tank reactor post-Pectinase reaction.

To demonstrate the scalability of the enzymatic process, 250 gallons of water heated to 45° C. was added to a 300 gal capacity tank. 4.8 kg of citric acid added, then 0.75 L of concentrated hydrochloric acid was added to adjust the pH to 2.0. 50 kg of lamb's ear was added to the tank with constant mixing, and hydrochloric acid was added to re-adjust the pH to 2.0 (FIG. 19A). 42.5 mL of Pectinase enzyme (*Aspergillus aculeatus* Sigma Cat. #P2611) was added to the tank and the suspension was stirred for 16 hours (FIG. 19B). The suspension was harvested and dewatered through screens, and trichomes were collected.

Example 9

Acid Release of Trichomes

Figure 20A:
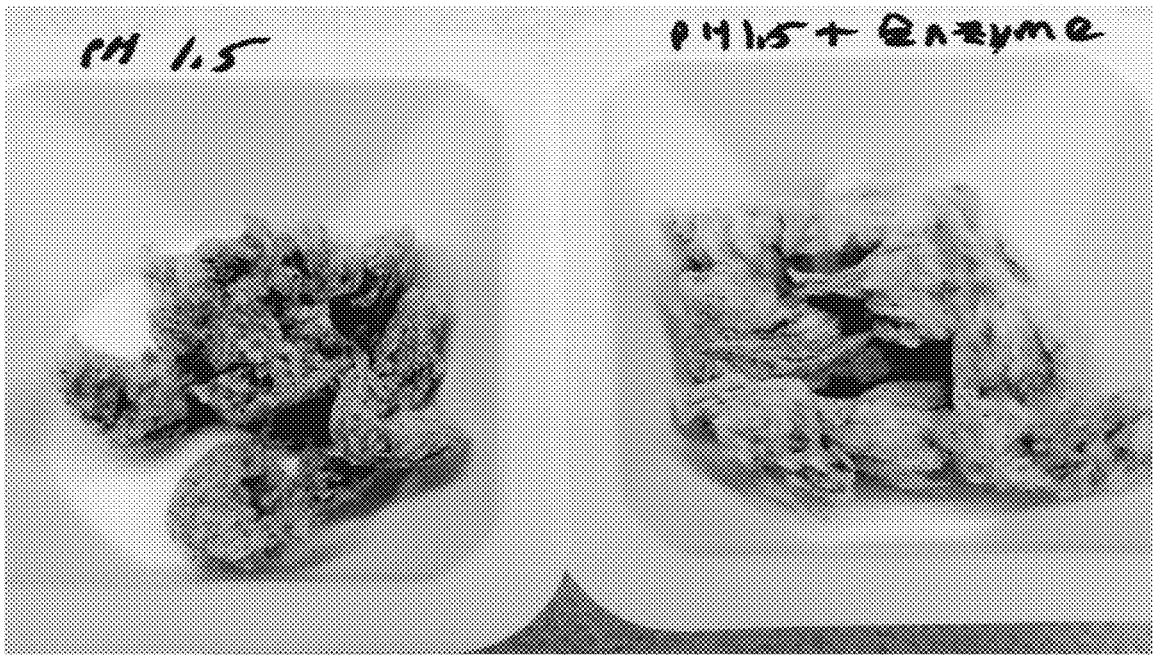
FIG. 20A is a photograph of trichomes recovered from fall harvest Lamb's Ear biomass using only pH 1.5 reaction medium, or the same with added Pectinase.
Figure 20B:
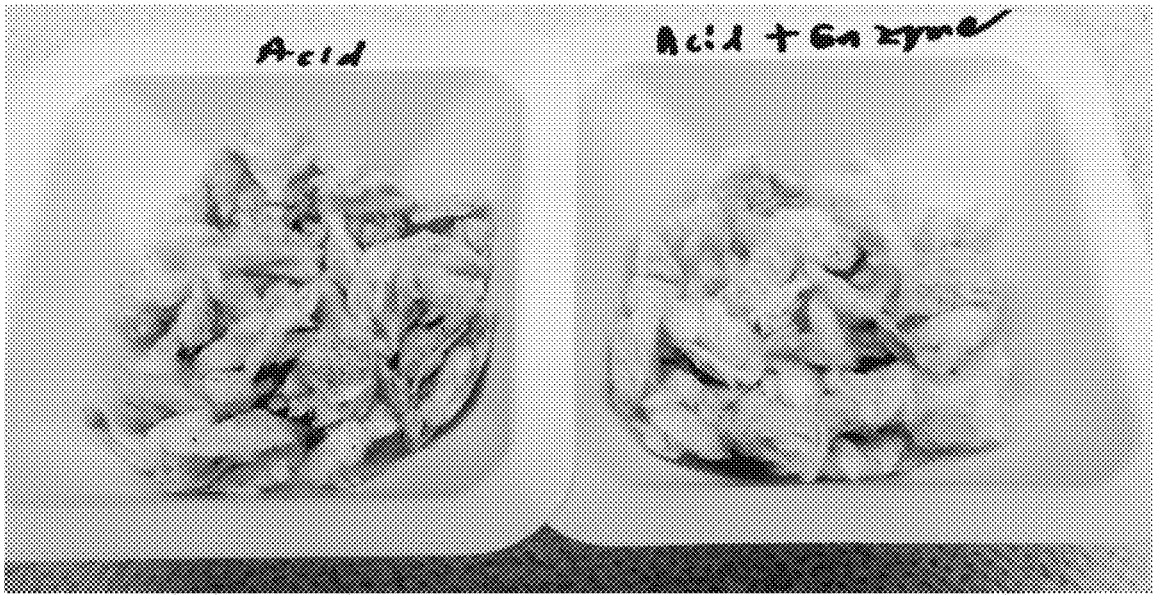
FIG. 20B is a photograph of trichomes recovered from summer harvest Lamb's Ear biomass using only pH 1.5 reaction medium, or the same with added Pectinase.
Figure 20C:
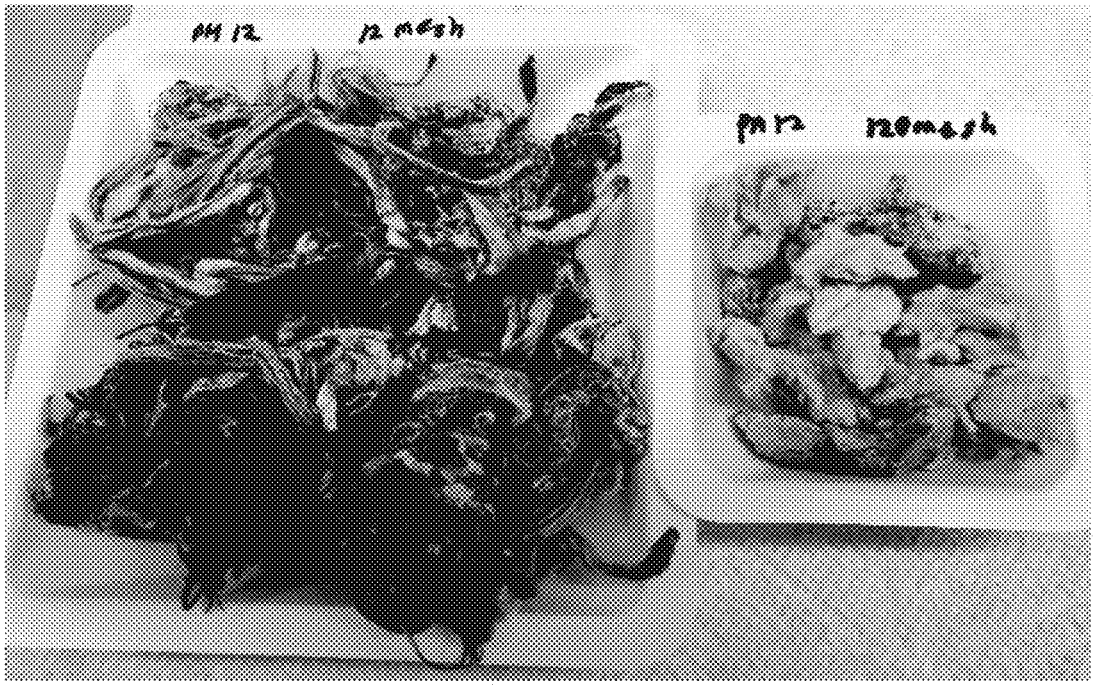
FIG. 20C is a photograph of 12 mesh retain and 120 mesh trichome retain from alkali pH 12 treated fall harvest Lamb's ear.

In a stirred vessel, 100 g of Lamb's Ear was added to 2 L of 25 mM Citric acid plus hydrochloric acid sufficient to adjust the pH to 1.5 and reacted at 45° C. for 16 h. In a second vessel, the same was reacted with the addition of Pectinase enzyme (SEBMash ultra Plus). Trichomes released by only acid were a darker shade than those released by acid and enzyme (FIG. 20A), and were released in lower yield than with the enzyme. However, it was demonstrated that acidic conditions alone could release a large amount of Trichomes. The quality of the fiber released by acid depends on the quality of the Lamb's Ear biomass used. When leaves harvested during active growth in the summer were used, the color of the trichomes released by acid alone and acid plus enzyme were closer in color than for the autumn harvested biomass shown in FIG. 20A (FIG. 20B), although the yield of the enzyme treated biomass was higher. Raising the temperature of the acid reaction to 60° C. enabled release after only 8 h, and 80° C. enabled trichome release within 4 h. Less trichomes are released as the pH is increased. To test whether highly alkaline conditions also released trichomes, the suspension was brought to pH 12 with sodium hydroxide and reacted. Some trichomes were released, but much fewer than with acid, and it was noticed that a much larger portion of the plant was not disrupted and did not pass through a 12 mesh screen (FIG. 20C).

Example 10

Scaled Up Acid Release

Figure 21A:
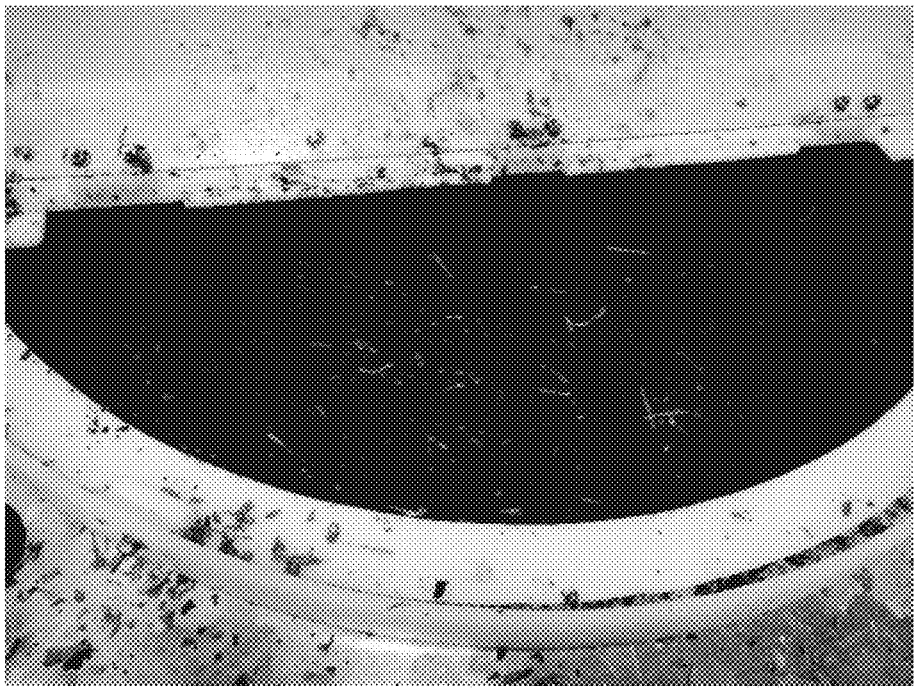
FIG. 21A is a photograph of post-300 gallon acid reaction of Lamb's Ear.
Figure 21B:
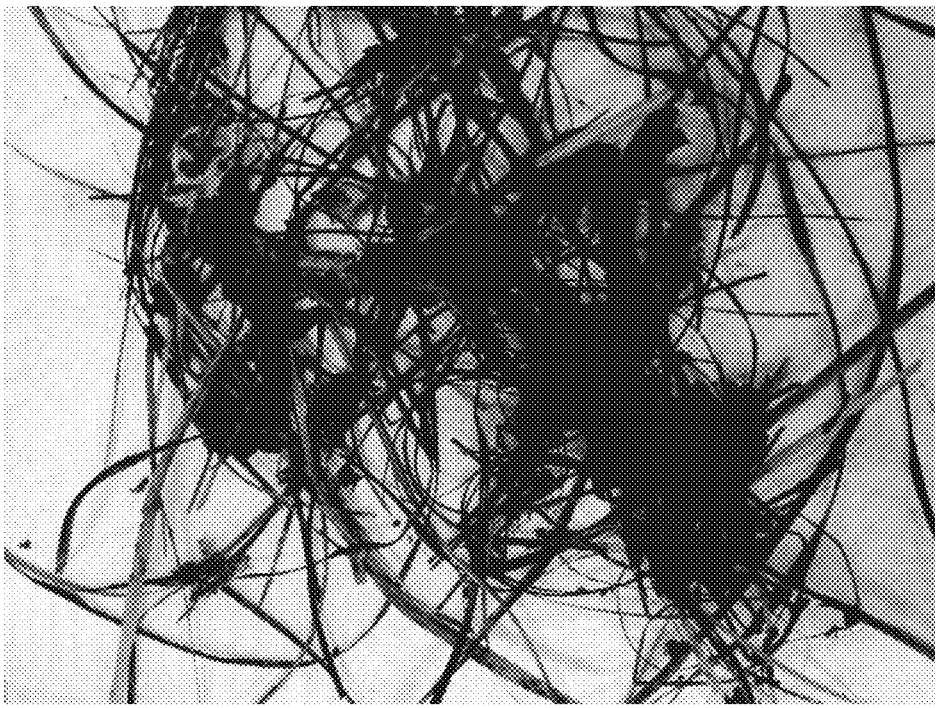
FIG. 21B is a photograph of undigested stems and grass impurities from the 300 gallon acid reaction.

To demonstrate the scalability of the acid process, 250 gallons of water heated to 50.6° C. was added to a 300 gal capacity tank. 49.6 kg of lamb's ear was added to the tank with constant mixing, and 2.57 L of concentrated hydrochloric acid was added to adjust the pH to 1.5-2.0. After 6 h, concentrated hydrochloric acid was added to adjust the pH to 1.5-2.0 and the suspension was continued to be mixed for a total of 18 hours. The leaves were predominantly disrupted (FIG. 21A), although the suspension is darker as compared to Pectinase reaction (compare to FIG. 19B). Grass leaf impurities in the Lamb's Ear biomass preparation were not degraded under these conditions (FIG. 21B). This demonstrates that using more mild conditions than is normally used in, e.g., cellulosic biomass deconstruction, this reaction is more specific for release of trichomes from Lamb's Ear.

Example 11

Grasses and Lamb's Ear Leaves Reaction with Pectinase

Figure 22A:
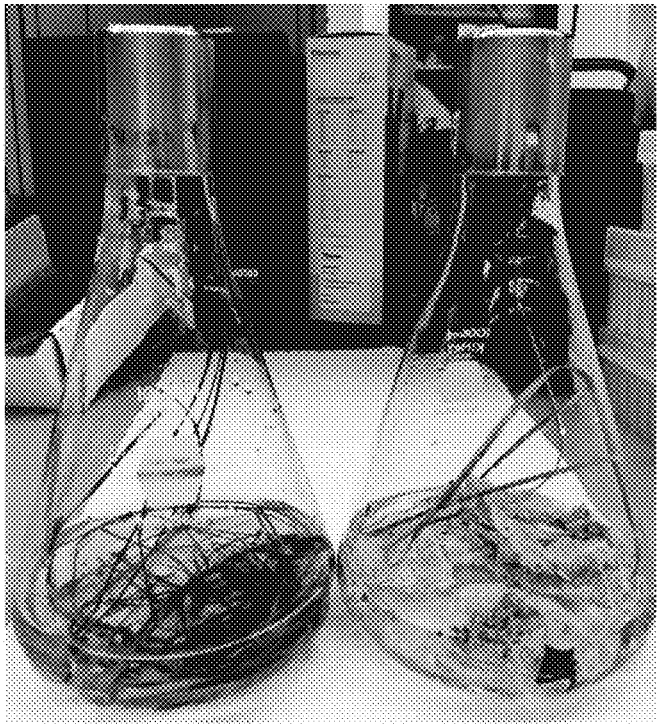
FIG. 22A is a photograph of undigested grass impurities from 300 gallon post-acid reaction and harvested Lamb's Ear leaves with some grass impurity.
Figure 22B:
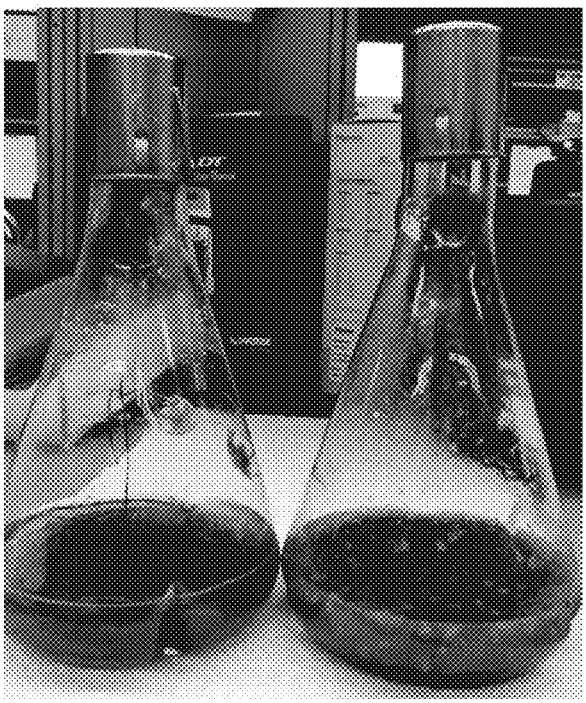
FIG. 22B is a photograph of undigested grass impurities from 300 gallon post-acid reaction and harvested Lamb's Ear leaves with some grass impurity reacted for 22 h at 40° C., pH 2.5 with 950 Units of Pectinase.
Figure 22C:
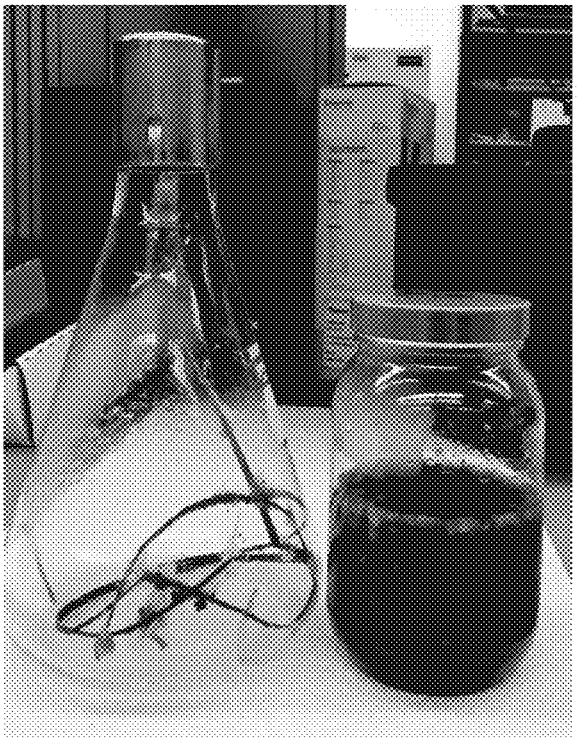
FIG. 22C is a photograph of pectinase reacted fresh Lamb's Ear separated into the undigested grass and the suspension of trichomes.
Figure 22D:
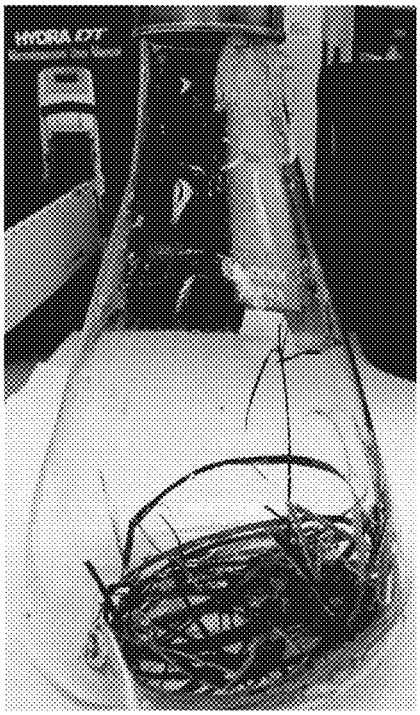
FIG. 22D is a photograph of pectinase reacted grass impurities from 300 gallon post-acid reaction.

Five grams each of unreacted grasses from the 300 gallon acid reactions (Example 10) and Lamb's Ear leaves with some grass impurity were reacted with Pectinase in 25 mM sodium citrate, pH 2.5 at 40° C. with shaking at 150 rpm. FIGS. 22A-22D are photographs of these reactions at Time 0 (FIG. 22A), 22 h (FIG. 22B), the leaves reaction split into unreacted grass and trichome suspension (FIG. 22C) and the unreacted grasses from the 300 gallon reaction (FIG. 22D). These observations are surprising and advantageous in that the conditions for both acid and enzymatic reactions do not appreciably affect the grass impurities, which should allow easier separation of the trichomes from grass impurities.

Example 12

Acid Plus Enzyme Release

To achieve the highest yield of fibers with lower levels of impurities at minimal time, a combination process was run in which the fibers were first exposed to acid at 80° C. for 4 h, then the temperature was lowered to 40° C. and the pH was raised to 2.5 with sodium hydroxide, and Pectinase was added. This was reacted for 8 h and the fibers recovered.

Fibrous Structures

The fibrous structures of the present invention may comprise greater than 50% and/or greater than 75% and/or greater than 90% and/or 100% or less by weight on a dry fiber basis of pulp fibers.

In one example, the fibrous structures of the present invention comprise less than 22% and/or less than 21% and/or less than 20% and/or less than 19% and/or less than 18% and/or to about 5% and/or to about 7% and/or to about 10% and/or to about 12% and/or to about 15% by weight on a dry fiber basis of softwood fibers.

In one example, the fibrous structures of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$ as measured according to the Basis Weight Test Method described herein.

In another example, the fibrous structures of the present invention may exhibit a basis weight of at least 21 $g/m^2$ and/or at least 23 $g/m^2$ and/or at least 25 $g/m^2$.

In yet another example, the fibrous structures of the present invention may comprise a plurality of pulp fibers, wherein greater than 0% but less than 20% by weight on a dry fiber basis of the pulp fibers are softwood fibers and wherein the fibrous structure comprises pulp fibers derived from a pulp fiber-producing source that has a growing cycle of less than 800 and/or every 400 and/or every 200 and/or every 100 or less days.

The fibrous structures of the present invention may comprise a trichome, especially a trichome fiber. In one example, a trichome fiber suitable for use in the fibrous structures of the present invention exhibit a fiber length of from about 100 μm to about 7000 μm and a width of from about 3 μm to about 30 μm.

In addition to a trichome, other fibers and/or other ingredients may also be present in the fibrous structures of the present invention.

Fibrous structures according to this invention may contain from about 0.1% to about 100% and/or from about 0.5% to about 50% and/or from about 1% to about 40% and/or from about 2% to about 30% and/or from about 5% to about 25% of trichomes, for example non-THC-containing trichomes, based on the dry weight of the fibrous structure.

Nonlimiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers for example a trichome layer (with or without additional hardwood pulp fibers, such as eucalyptus) on at least one exterior surface and a softwood pulp fiber layer, such as Northern Softwood Kraft (NSK) and/or Southern Softwood Kraft (SSK) pulp fibers as another layer, for example a center layer in a three or more layer construction) construction; and the sanitary tissue products made therefrom may be of a single-ply or multi-ply construction.

The fibrous structures and/or sanitary tissue products of the present invention may exhibit a basis weight of between about 10 $g/m^2$ to about 120 $g/m^2$ and/or from about 14 $g/m^2$ to about 80 $g/m^2$ and/or from about 20 $g/m^2$ to about 60 $g/m^2$.

The structures and/or sanitary tissue products of the present invention may exhibit a total (i.e. sum of machine direction and cross machine direction) dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structure and/or sanitary tissue products of the present invention may exhibit a density of less than about 0.60 $g/cm^3$ and/or less than about 0.30 $g/cm^3$ and/or less than about 0.20 $g/cm^3$ and/or less than about 0.10 $g/cm^3$ and/or less than about 0.07 $g/cm^3$ and/or less than about 0.05 $g/cm^3$ and/or from about 0.01 $g/cm^3$ to about 0.20 $g/cm^3$ and/or from about 0.02 $g/cm^3$ to about 0.10 $g/cm^3$.

The fibrous structures and/or sanitary tissue products of the present invention may exhibit a stretch at peak load (measured in direction of maximum stretch at peak load) of at least about 10% and/or at least about 15% and/or at least about 20% and/or from about 10% to about 70% and/or from about 10% to about 50% and/or from about 15% to about 40% and/or from about 20% to about 40%.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a trichome in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

In addition to a trichome, the fibrous structure may comprise other additives, such as wet strength additives, softening additives, solid additives (such as starch, clays), dry strength resins, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

Processes for Making Trichome-Containing Fibrous Structures

Any suitable process for making fibrous structures known in the art may be used to make trichome-containing fibrous structures of the present invention.

In one example, the trichome-containing fibrous structures of the present invention are made by a wet laid fibrous structure making process.

In another example, the trichome-containing fibrous structures of the present invention are made by an air laid fibrous structure making process.

In one example, a trichome-containing fibrous structure is made by the process comprising the steps of: a) preparing a fiber furnish (slurry) by mixing a trichome with water; b) depositing the fiber furnish on a foraminous forming surface to form an embryonic fibrous web; and c) drying the embryonic fibrous web.

In one example, a fiber furnish comprising a trichome, such as a trichome fiber, is deposited onto a foraminous forming surface via a headbox.

The following Example illustrates a nonlimiting example for the preparation of sanitary tissue product comprising a fibrous structure according to the present invention on a pilot-scale Fourdrinier fibrous structure making machine.

Individualized trichomes are first prepared from *Stachys byzantina* bloom stalks consisting of the dried stems, leaves, and pre-flowering buds, by passing dried *Stachys byzantina* plant matter through a knife cutter (Wiley mill, manufactured by the C. W. Brabender Co. located in South Hackensack, N.J.) equipped with an attrition screen having ¼" holes. Exiting the Wiley mill is a composite fluff constituting the individualized trichome fibers together with chunks of leaf and stem material. The individualized trichome fluff is then passed through an air classifier (Hosokawa Alpine 50ATP); the "accepts" or "fine" fraction from the classifier is greatly enriched in individualized trichomes while the "rejects" or "coarse" fraction is primarily chunks of stalks, and leaf elements with only a minor fraction of individualized trichomes. A squirrel cage speed of 9000 rpm, an air pressure resistance of 10-15 mbar, and a feed rate of about 10 g/min are used on the 50 ATP. The resulting individualized trichome material (fines) is mixed with a 10% aqueous dispersion of "Texcare 4060" to add about 10% by weight "Texcare 4060" by weight of the bone dry weight of the individualized trichomes followed by slurrying the "Texcare"-treated trichomes in water at 3% consistency using a conventional repulper. This slurry is passed through a stock pipe toward another stock pipe containing eucalyptus fiber slurry.

The aqueous slurry of eucalyptus fibers is prepared at about 3% by weight using a conventional repulper. This slurry is also passed through a stock pipe toward the stock pipe containing the trichome fiber slurry.

The 3% trichome slurry is combined with the 3% eucalyptus fiber slurry in a proportion which yields about 13.3% trichome fibers and 86.7% eucalyptus fibers. The stockpipe containing the combined trichome and eucalyptus fiber slurries is directed toward the headbox of a fourdrinier machine.

Separately, an aqueous slurry of NSK fibers of about 3% by weight is made up using a conventional repulper.

In order to impart temporary wet strength to the finished fibrous structure, a 1% dispersion of temporary wet strengthening additive (e.g., Parez® 750) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The trichome and eucalyptus fiber slurry is diluted with white water at the inlet of a fan pump to a consistency of about 0.15% based on the total weight of the eucalyptus and trichome fiber slurry. The NSK fibers, likewise, are diluted with white water at the inlet of a fan pump to a consistency of about 0.15% based on the total weight of the NSK fiber slurry. The eucalyptus/trichome fiber slurry and the NSK fiber slurry are both directed to a layered headbox capable of maintaining the slurries as separate streams until they are deposited onto a forming fabric on the Fourdrinier.

"DC 2310" antifoam is dripped into the wirepit to control foam to maintain whitewater levels of 10 ppm of antifoam.

The fibrous structure making machine has a layered headbox having a top chamber, a center chamber, and a bottom chamber. The eucalyptus/trichome combined fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus/trichome fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 g/m$^2$.

The sanitary tissue paper product is very soft and absorbent.

In one example, a trichome suitable for use in the fibrous structures of the present invention comprises cellulose.

In yet another example, a trichome suitable for use in the fibrous structures of the present invention comprises a fatty acid.

In still another example, a trichome suitable for use in the fibrous structures of the present invention is hydrophobic.

In yet another example, a trichome suitable for use in the fibrous structures of the present invention is less hydrophilic that softwood fibers. This characteristic of the trichome may facilitate a reduction in drying temperatures needed to dry fibrous structures comprising such trichome and/or may facilitate making the fibrous structures containing such trichome at a faster rate.

As shown in FIG. 1, numerous trichomes 10 are present on this red clover leaf and leaf stem. FIG. 2 shows numerous trichomes 10 present on a red clover lower stem.

As shown in FIG. 3, a dusty miller leaf contains numerous trichomes 10. FIG. 4 shows individualized trichomes 10A obtained from a dusty miller leaf.

As shown in FIG. 5, a basal leaf on a silver sage contains numerous trichomes 10. FIG. 6 shows trichomes 10 present on a bloom-stalk leaf of a silver sage.

As shown in FIG. 7, trichomes 10 are present on a mature leaf of common mullein. FIG. 8 shows trichomes 10 present on a juvenile leaf of common mullein.

FIG. 9 shows, via a perpendicular view, trichomes 10 present on a leaf of wooly betony. FIG. 10 is a cross-sectional view of a leaf of wooly betony containing trichomes 10. FIG. 11 shows individualized trichomes 10A obtained from a wooly betony leaf.

Trichome fibers are greater in length than Eucalyptus fibers, but shorter than NSK fibers. However, other properties of trichome fibers are more closely associated with properties of Eucalyptus fibers than to NSK fibers.

The fibrous structures of the present invention may comprise greater than 50% and/or greater than 75% and/or greater than 90% and/or 100% or less by weight on a dry fiber basis of pulp fibers.

In one example, the fibrous structures of the present invention comprise less than 22% and/or less than 21% and/or less than 20% and/or less than 19% and/or less than 18% and/or to about 5% and/or to about 7% and/or to about 10% and/or to about 12% and/or to about 15% by weight on a dry fiber basis of softwood fibers.

In one example, the fibrous structures of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$ as measured according to the Basis Weight Test Method described herein.

In another example, the fibrous structures of the present invention may exhibit a basis weight of at least 21 $g/m^2$ and/or at least 23 $g/m^2$ and/or at least 25 $g/m^2$.

In yet another example, the fibrous structures of the present invention may comprise a plurality of pulp fibers, wherein greater than 0% but less than 20% by weight on a dry fiber basis of the pulp fibers are softwood fibers and wherein the fibrous structure comprises pulp fibers derived from a pulp fiber-producing source that has a growing cycle of less than 800 and/or every 400 and/or every 200 and/or every 100 or less days.

The fibrous structures of the present invention may comprise one or more individualized trichomes, especially trichome fibers. In one example, a trichome fiber suitable for use in the fibrous structures of the present invention exhibit a fiber length of from about 100 μm to about 7000 μm and a width of from about 3 μm to about 30 μm.

In addition to a trichome, other fibers and/or other ingredients may also be present in the fibrous structures of the present invention.

Fibrous structures according to this invention may contain from about 0.1% to about 100% and/or from about 0.5% to about 90% and/or from about 0.5% to about 80% and/or from about 0.5% to about 50% and/or from about 1% to about 40% and/or from about 2% to about 30% and/or from about 5% to about 25% by weight on a dry fiber basis of trichome fibers.

In addition to a trichome, the fibrous structure may comprise other additives, such as wet strength additives, softening additives, solid additives (such as starch, clays), dry strength resins, wetting agents, lint resisting and/or reducing agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

Non-limiting Example of a Fibrous Structure of the Present Invention

Example: Fibrous Structure with Trichome Fibers

This following example illustrates a non-limiting example for the preparation of a fibrous structure according to the present invention on a pilot-scale Fourdrinier paper making machine with the addition of trichome fibers providing a strength increase.

The following Example illustrates a non-limiting example for the preparation of sanitary tissue product comprising a fibrous structure according to the present invention on a pilot-scale Fourdrinier fibrous structure making machine.

Individualized trichome are first prepared from *Stachys byzantina* bloom stalks consisting of the dried stems, leaves, and pre-flowering buds, according to the process according to the present invention to obtain the trichomes, for example non-THC-containing trichomes, and/or trichome composition comprising the plurality of trichomes, for example non-THC-containing trichomes, of the present invention.

Special care must be taken while processing the trichomes. 60 lbs. of trichome fiber is pulped in a 50 gallon pulper by adding water in half amount required to make a 1% trichome fiber slurry. This is done to prevent trichome fibers over flowing and floating on surface of the water due to lower density and hydrophobic nature of the trichome fiber. After mixing and stirring a few minutes, the pulper is stopped and the remaining trichome fibers are pushed in while water is added. After pH adjustment, it is pulped for 20 minutes, then dumped in a separate chest for delivery onto the machine headbox. This allows one to place trichome fibers in one or more layers, alone or mixed with other fibers, such as hardwood fibers and/or softwood fibers. During this particular run, the trichome fibers are added exclusively on the wire outer layer as the product is converted wire side up; therefore it is desirable to add the trichome fibers to the wire side (the side where the tactile feel senses paper the most).

The aqueous slurry of eucalyptus fibers is prepared at about 3% by weight using a conventional repulper. This slurry is also passed through a stock pipe toward the stock pipe containing the trichome fiber slurry.

The 1% trichome fiber slurry is combined with the 3% eucalyptus fiber slurry in a proportion which yields about 13.3% trichome fibers and 86.7% eucalyptus fibers. The stockpipe containing the combined trichome and eucalyptus fiber slurries is directed toward the wire layer of headbox of a Fourdrinier machine.

Separately, an aqueous slurry of NSK fibers of about 3% by weight is made up using a conventional repulper.

In order to impart temporary wet strength to the finished fibrous structure, a 1% dispersion of temporary wet strengthening additive (e.g., Parez® commercially available from Kemira) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The trichome fiber and eucalyptus fiber slurry is diluted with white water at the inlet of a fan pump to a consistency of about 0.15% based on the total weight of the eucalyptus and trichome fiber slurry. The NSK fibers, likewise, are diluted with white water at the inlet of a fan pump to a consistency of about 0.15% based on the total weight of the NSK fiber slurry. The eucalyptus/trichome fiber slurry and the NSK fiber slurry are both directed to a layered headbox capable of maintaining the slurries as separate streams until they are deposited onto a forming fabric on the Fourdrinier.

"DC 2310" antifoam is dripped into the wirepit to control foam to maintain whitewater levels of 10 ppm of antifoam. The fibrous structure making machine has a layered headbox having a top chamber, a center chamber, and a bottom chamber. The eucalyptus/trichome combined fiber slurry is pumped through the top headbox chamber, eucalyptus fiber slurry is pumped through the bottom headbox chamber, and, simultaneously, the NSK fiber slurry is pumped through the center headbox chamber and delivered in superposed relation onto the Fourdrinier wire to form thereon a three-layer embryonic web, of which about 83% is made up of the eucalyptus/trichome fibers and 17% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 g/m$^2$.

5% by weight of trichome fibers on the outer layer of the sheet produced a product with considerable softness. To control tensile, softwood fibers had to be removed by 7% to compensate for 5% addition of trichome fibers. The base product had a softness of −0.44 PSU compared to our standard but the fibrous structure made with trichome fibers had 1.05 PSU at a comparable wet and dry tensile. Adjusting for the base softness deficit the condition with trichome fibers softness would be at about 1.5 PSU. Other benefits of trichome fiber addition is that the pre-dryer temperatures may be reduced by at least 30° F., and in one example at least 30° F. to about 50° F.

This is a significant temperature reduction that can be used for energy saving or increase machine capacity if it is drying limited. In addition to the benefits described above, the use of trichome fibers to reduce the use of pulp fibers, especially softwood pulp fibers, in making fibrous structures, such as sanitary tissue products, also has environmental benefits, such as reducing carbon footprint of fibrous structures, especially paper products that have historically been made from wood pulp, by reducing the usage wood pulp and thus tree usage while maintaining or increasing the softness of the fibrous structures. In addition, as is always clear from the above description, the use of trichome fibers in fibrous structure breaks the strength/softness contradiction that has historically plagued the fibrous structure, especially the sanitary tissue product industry by increasing strength while increasing softness of the fibrous structure.

The following table shows the results for the fibrous structure.

TABLE 5

| | 5% Trichome Fibers |
|---|---|
| SW % used | 17 |
| Total Tensile (gm/in) | 523 |
| Softness | 1.05 |

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in ±0.0035 in is used to prepare all samples. With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No.of squares in stack)]

For example,

Basis Weight (lbs/3000 $ft^2$)=[[Mass of stack (g)/453.6 (g/lbs)]/[12.25 ($in^2$)/144 ($in^2/ft^2$)×12]]×3000 or,

Basis Weight ($g/m^2$)=Mass of stack (g)/[79.032 ($cm^2$)/10,000 ($cm^2/m^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

% Curl Test Method

Figure 23:
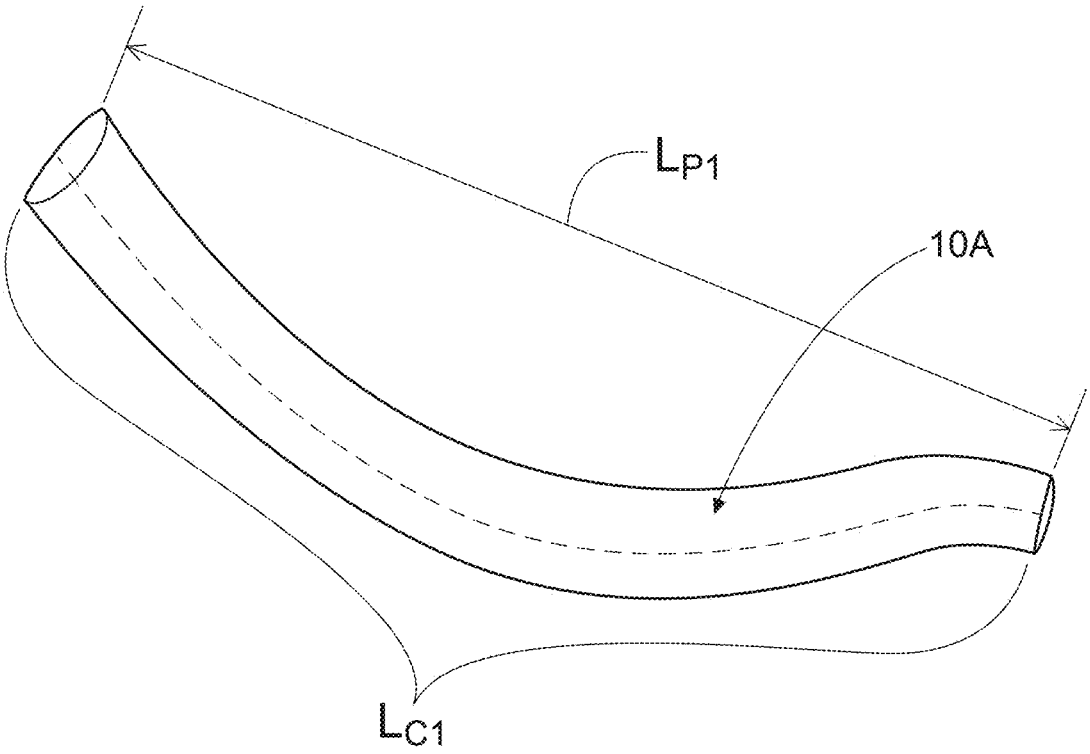
FIG. 23 is a schematic representation of an example of an individualized trichome being measured according to the % Curl Test Method.

The % Curl of trichomes is measured as shown in FIG. 23 and calculated as follows. Measure the true length of an individualized trichome 10A (along its center line of its physical form, typically not a straight line—along its actual length from one end to the opposite end) ($L_{c1}$). Measure the projected length of the individualized trichome 10A (its linear measurement—the length of a straight line from one end to the opposite end) ($L_{p1}$). The measurements need to be in the same units. Then, calculate the % Curl by the following equation:

$$\% \text{ Curl}=(L_{c1}/L_{p1}-1)\times 100\%$$

% Hydrophobe Extracted Test Method

The % Hydrophobe Extracted from trichomes is measured according to the following test method.

Approximately 3 grams of trichome sample is packed into a soxhlet cellulose thimble (25 mm×100 mm). The packed thimble is then inserted down into a soxhlet extractor. A 100 mL tared round bottom flask loaded with 100 mL of methylene chloride and a stir bar are attached to the soxhlet extractor equipped with a reflux condenser above the unit. The unit is then heated to refluxed with a heating/stirring plate for 7 hours. After 7 hours the system is allowed to cool to 23° C.±1.0° C. The stir bar is then removed from the round bottom flask and the methylene chloride is evaporated on a rotovap unit and then dried under high vacuum for 2 hours to remove any trace methylene chloride. The remaining residue in the round bottom flask is weighed and compared to the tared empty round bottom flask weight to calculate the amount of residue obtained from the soxhlet extraction process and an overall percentage yield relative to the amount of trichome fiber sample loaded into the thimble (Weight Percent Extracted).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular examples of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-tetrahydrocannabinol (THC)-containing trichome composition comprising a plurality of non-THC-containing trichomes and a plurality of hardwood fibers, such that a resulting structure comprises greater than 80% trichome and hardwood fibers, wherein the non-THC-containing trichome composition exhibits one or more of the following characteristics:

a. a Fiber Length distribution such that greater than 0.1% of the non-THC-containing trichomes exhibit lengths in the range of 3.20 mm to 7.60 mm;

b. a Fiber Length distribution such that less than 2.50% of the non-THC-containing trichomes exhibit lengths in the range of 0.00 mm to 0.20 mm;

c. a % Curl of the non-THC-containing trichomes of greater than 14.25% as measured according to the % Curl Test Method; and d. a % Hydrophobe Extracted from the non-THC-containing trichomes of greater than 1.80% as measured according to the % Hydrophobe Extracted Test Method.

2. The trichome composition according to claim 1 wherein the non-THC-containing trichome composition exhibits a Fiber Length distribution such that less than 0.25% of the non-THC-containing trichomes exhibit lengths in the range of 0.00 mm to 0.20 mm.

3. The trichome composition according to claim 1 wherein the non-THC-containing trichome composition exhibits a Fiber Length distribution such that greater than 0.00% to less than 2.50% of the non-THC-containing trichomes exhibit lengths in the range of 0.00 mm to 0.20 mm.

4. The trichome composition according to claim 1 wherein the non-THC-containing trichome composition exhibits a % Curl of the non-THC-containing trichomes of greater than 14.25% but less than 30.00% as measured according to the % Curl Test Method.

5. The trichome composition according to claim 1 wherein the non-THC-containing trichome composition exhibits a % Curl of the non-THC-containing trichomes of greater than 16.00% but less than 22.00% as measured according to the % Curl Test Method.

6. A fibrous structure comprising a plurality of trichomes and a plurality of hardwood fibers, such that a resulting structure comprises greater than 80% trichome and hardwood fibers, wherein the trichomes exhibit one or more of the following characteristics:

a. a Fiber Length distribution such that greater than 0.2% of the trichomes exhibit lengths in the range of 3.20 mm to 7.60 mm;

b. a Fiber Length distribution such that less than 1.00% of the trichomes exhibit lengths in the range of 0.00 mm to 0.20 mm;

c. a % Curl of the trichomes of greater than 15.00% as measured according to the % Curl Test Method; and d. a % Hydrophobe Extracted from the trichomes of greater than 2.10% as measured according to the % Hydrophobe Extracted Test Method.

7. The fibrous structure according to claim 6 wherein the non-THC-containing trichomes exhibits a Fiber Length distribution such that less than 0.85% of the non-THC-containing trichomes exhibit lengths in the range of 0.00 mm to 0.20 mm.

8. The fibrous structure according to claim 6 wherein the non-THC-containing trichomes exhibits a Fiber Length distribution such that greater than 0.00% to less than 1.00% of the non-THC-containing trichomes exhibit lengths in the range of 0.00 mm to 0.20 mm.

9. The fibrous structure according to claim 6 wherein the non-THC-containing trichomes exhibits a % Curl of the non-THC-containing trichomes of greater than 15.00% but less than 30.00% as measured according to the % Curl Test Method.

10. The fibrous structure according to claim 6 wherein the non-THC-containing trichomes exhibits a % Hydrophobe Extracted from the non-THC-containing trichomes of greater than 2.10% but less than 10.00% as measured according to the % Hydrophobe Extracted Test Method.

11. The fibrous structure according to claim 6 wherein the fibrous structure comprises from about 0.1% to about 100% by weight of the non-THC-containing trichomes based on the dry weight of the fibrous structure.

12. A sanitary tissue product comprising a fibrous structure according to claim 6.

* * * * *